US012077402B2

(12) United States Patent
Xie et al.

(10) Patent No.: US 12,077,402 B2
(45) Date of Patent: Sep. 3, 2024

(54) IMAGE PROCESSING APPARATUS

(71) Applicant: BROTHER KOGYO KABUSHIKI KAISHA, Nagoya (JP)

(72) Inventors: Tianjin Xie, Nagoya (JP); Akinari Ishibe, Okazaki (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 4 days.

(21) Appl. No.: 17/516,285

(22) Filed: Nov. 1, 2021

(65) Prior Publication Data

US 2022/0144566 A1 May 12, 2022

(30) Foreign Application Priority Data

Nov. 5, 2020 (JP) ..... 2020-185323

(51) Int. Cl.
*B65H 3/34* (2006.01)
*B65H 3/06* (2006.01)
(Continued)

(52) U.S. Cl.
CPC ..... *B65H 3/34* (2013.01); *B65H 3/0669* (2013.01); *B65H 3/0684* (2013.01);
(Continued)

(58) Field of Classification Search
CPC ..... B65H 1/04; B65H 3/0669; B65H 3/0684; B65H 3/34; B65H 3/5215; B65H 3/5223;
(Continued)

(56) References Cited

U.S. PATENT DOCUMENTS

2008/0246210 A1* 10/2008 Lee ..... B65H 3/0684 271/109
2010/0025927 A1 2/2010 Kotaka et al.
(Continued)

FOREIGN PATENT DOCUMENTS

JP S63-015235 A 1/1988
JP H02-163220 A 6/1990
(Continued)

OTHER PUBLICATIONS

Japan Patent Office; Notice of Reasons for Refusal issued in Japanese Patent Application No. 2020-185323, dated Jun. 28, 2024.

*Primary Examiner* — Prasad V Gokhale
(74) *Attorney, Agent, or Firm* — Baker Botts L.L.P.

(57) ABSTRACT

An image processing apparatus includes: a support surface configured to support a sheet, a sheet feeding roller configured to feed the sheet in a conveying direction, a separation member for separating the sheet one by one and positioned downstream of the sheet feeding roller in the conveying direction, and a regulating member displaceable between a first position where the regulating member abuts against a distal end of the sheet supported by the support surface to regulate passage of the sheet in the conveying direction between the sheet feeding roller and the separation member and a second position that is farther from a conveyance path than the first position and that allows passage of the sheet in the conveying direction. The regulating member has a wall surface that abuts against the distal end of the sheet and includes at least one protrusion on the wall surface.

12 Claims, 17 Drawing Sheets

(51) Int. Cl.

| | |
|---|---|
| ***B65H 3/52*** | (2006.01) |
| ***B65H 3/56*** | (2006.01) |
| ***B65H 3/68*** | (2006.01) |
| ***B65H 5/06*** | (2006.01) |
| ***B65H 7/04*** | (2006.01) |

(52) U.S. Cl.
CPC ..... *B65H 3/5215* (2013.01); *B65H 3/5261* (2013.01); *B65H 3/56* (2013.01); *B65H 3/68* (2013.01); *B65H 5/062* (2013.01); *B65H 7/04* (2013.01)

(58) Field of Classification Search
CPC ..... B65H 3/5261; B65H 3/56; B65H 3/66; B65H 3/68; B65H 7/04; B65H 9/04; B65H 9/06; B65H 2405/1111

See application file for complete search history.

(56) References Cited

U.S. PATENT DOCUMENTS

| | | | | |
|---|---|---|---|---|
| 2013/0154182 | A1* | 6/2013 | Hsu | B65H 3/34 271/256 |
| 2017/0066618 | A1* | 3/2017 | Adachi | B65H 3/56 |
| 2017/0297838 | A1 | 10/2017 | Hanamoto | |
| 2018/0257888 | A1* | 9/2018 | Hanamoto | B65H 3/5207 |
| 2019/0062087 | A1 | 2/2019 | Sawashima et al. | |
| 2019/0144225 | A1* | 5/2019 | Nishizaka | B65H 3/56 271/121 |
| 2020/0039770 | A1* | 2/2020 | Chiang | H04N 1/0057 |
| 2022/0411212 | A1* | 12/2022 | Oshiro | B65H 3/0676 |
| 2023/0373739 | A1* | 11/2023 | Lee | B65H 3/66 |

FOREIGN PATENT DOCUMENTS

| | | | |
|---|---|---|---|
| JP | H03-076834 | U | 8/1991 |
| JP | H06-183589 | A | 7/1994 |
| JP | 2010-037020 | A | 2/2010 |
| JP | 2017-190236 | A | 10/2017 |
| JP | 2019-099307 | A | 6/2019 |

* cited by examiner

IMAGE PROCESSING APPARATUS

CROSS-REFERENCE TO RELATED APPLICATIONS

This application claims priority from Japanese Patent Application No. 2020-185323 filed on Nov. 5, 2020, the entire contents of which are incorporated herein by reference.

BACKGROUND

A related image processing apparatus includes a regulating member between a first conveyance roller and a second conveyance roller. The regulating member is switched from a second position mode in which the regulating member is retracted from a conveyance path of paper to a first position mode in which the regulating member appears on the conveyance path of the paper, so that the regulating member abuts against a distal end of the paper delivered by the first conveyance roller and regulates passage of the paper.

SUMMARY

One illustrative aspect of the present disclosure provides an image processing apparatus including: a support surface, a sheet feeding roller, a separation member, and a regulating member. The support surface is configured to support a sheet. The sheet feeding roller is configured to feed the sheet supported by the support surface in a conveying direction. The separation member separates the sheet supported by the support surface one by one and is positioned downstream of the sheet feeding roller in the conveying direction. The regulating member is positioned between the sheet feeding roller and the separation member. The regulating member is displaceable between a first position and a second position. The first position is a position where the regulating member abuts against a distal end of the sheet supported by the support surface to regulate passage of the sheet in the conveying direction between the sheet feeding roller and the separation member. The second position is a position that is farther from a conveyance path than the first position and that allows passage of the sheet in the conveying direction. The regulating member has a wall surface that abuts against the distal end of the sheet and includes at least one protrusion on the wall surface.

In the image processing apparatus according to the present disclosure, the regulating member that regulates passage of the sheet supported on the support surface in the conveying direction is provided to be displaceable to the first position or the second position. At the first position, the regulating member abuts against the distal end of the sheet supported by the support surface and regulates passage of the sheet in the conveying direction. At the second position farther from the conveyance path than the first position, the regulating member allows passage of the sheet in the conveying direction.

When abutting against the distal end of the sheet at the first position, the regulating member includes the at least one protrusion on the wall surface that abuts against the distal end of the sheet. Accordingly, when the distal end of the sheet fed by a user abuts against the regulating member, the distal end of the sheet hits and is caught by the protrusion of the wall surface. Therefore, the distal end of the sheet is prevented from sliding on the surface of the wall surface and curving upward or downward. Accordingly, usability for the user can be improved.

BRIEF DESCRIPTION OF DRAWINGS

Illustrative embodiments of the disclosure will be described in detail based on the following figures, wherein.

DETAILED DESCRIPTION

In the related image processing apparatus described above, when a user inserts paper in a state where the regulating member is switched to the first position mode, the distal end of the paper may curve upward or downward along the regulating member after the distal end of the paper abuts against the regulating member. In this case, since it is difficult for the user to get a feeling that the paper hits a distal end of the regulating member, it is insufficient in terms of usability.

Therefore, illustrative aspects of the present disclosure provide an image processing apparatus that can prevent a distal end of a sheet from abutting against a regulating member and curving and can improve usability.

Hereinafter, an embodiment of the present disclosure will be described with reference to the drawings. Each drawing is used for explaining technical characteristics that can be adopted in the present disclosure, and the configuration and the like of the apparatus described are not intended to be limited thereto, but are merely explanatory examples.

Overall Schematic Configuration of Multifunction Device

Figure 1:
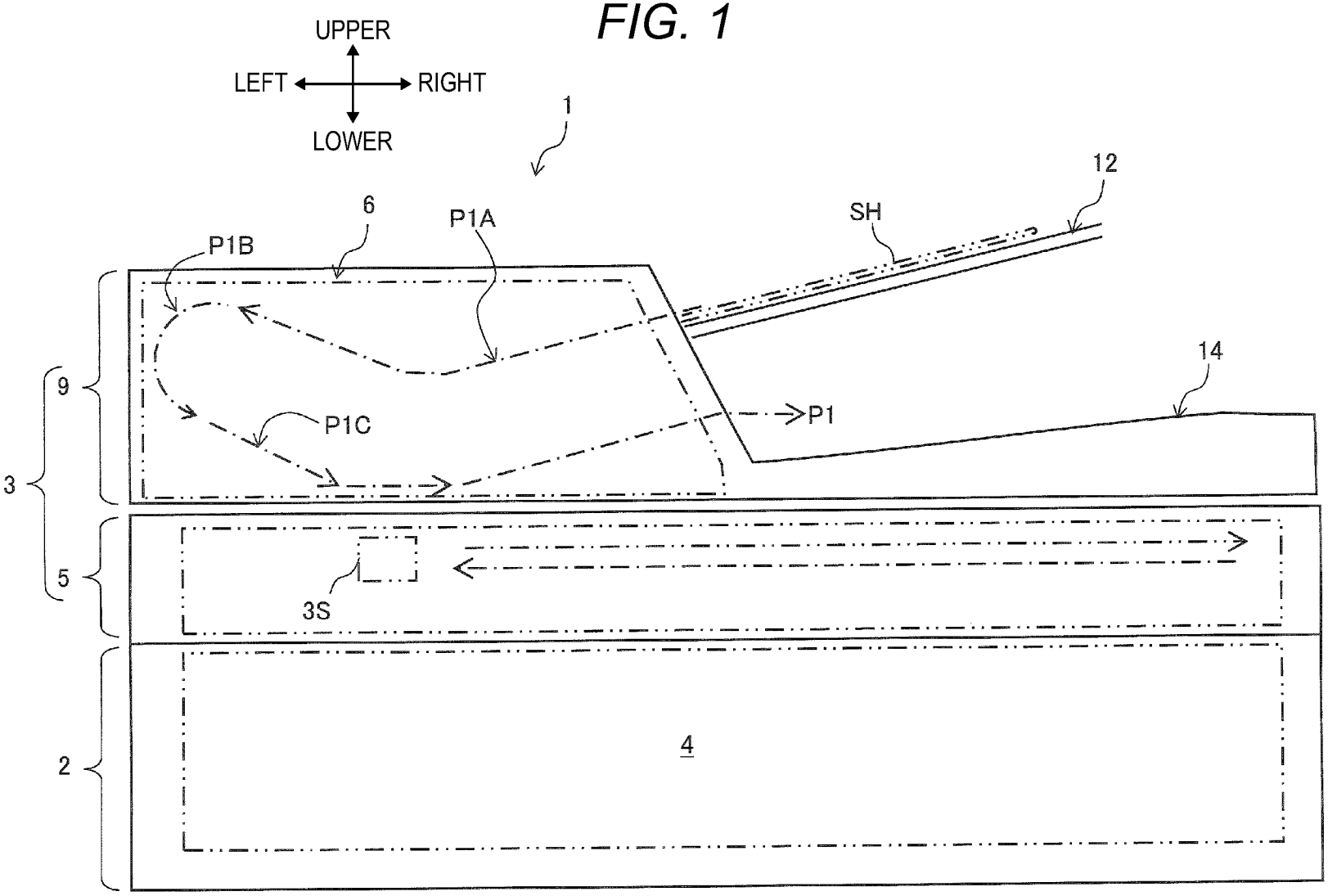
FIG. 1 is a schematic diagram showing a conceptual overall configuration of a multifunction device according to an embodiment of the present disclosure.

FIG. 1 conceptually shows an overall schematic configuration of a multifunction device 1 according to the present embodiment. The multifunction device 1 is an example of an image processing apparatus. In the multifunction device 1 shown in FIG. 1, a front side of a drawing sheet is defined as a front side of the apparatus, a left side of the drawing sheet is defined as a left side, and front and rear directions, left and right directions, and upper and lower directions are displayed. Then, directions shown in the following drawings are all displayed in correspondence with directions shown in FIG. 1.

As shown in FIG. 1, the multifunction device 1 includes a main body unit 2 and a reader 3. The reader 3 includes an automatic document feeder 9 (hereinafter, referred to as an ADF 9) and a flat-bed unit 5 (hereinafter, referred to as an FB unit 5). An operation panel 40 (see FIG. 12 described later), which is a touch panel or the like, is provided on a front surface of the FB unit 5 of the ADF 9.

As shown in FIG. 1, the main body unit 2 is a flat, substantially box-shaped body, and includes an image forming unit 4 therein. The image forming unit 4 forms an image on a recording sheet by an inkjet method, a laser method, or the like based on image data received from a personal computer connected to the multifunction device 1, image data generated by reading an image of a document by the reader 3, or the like. The reader 3 is disposed above the main body unit 2. The FB unit 5 is used when reading an image of a document placed on a document support surface 101A, which will be described later. The ADF 9 includes a supply tray 12, a discharge tray 14, and a conveyance unit 6. The conveyance unit 6 conveys sheets SH placed on the supply tray 12 along a conveyance path P1 and discharges the sheets SH to the discharge tray 14. The ADF 9 is used to read images of the sheets SH placed on the supply tray 12 while sequentially conveying the images along the conveyance path P1. The sheet to be read includes a sheet such as paper or an OHP sheet, a document, and the like.

Appearance of ADF

Figure 2:
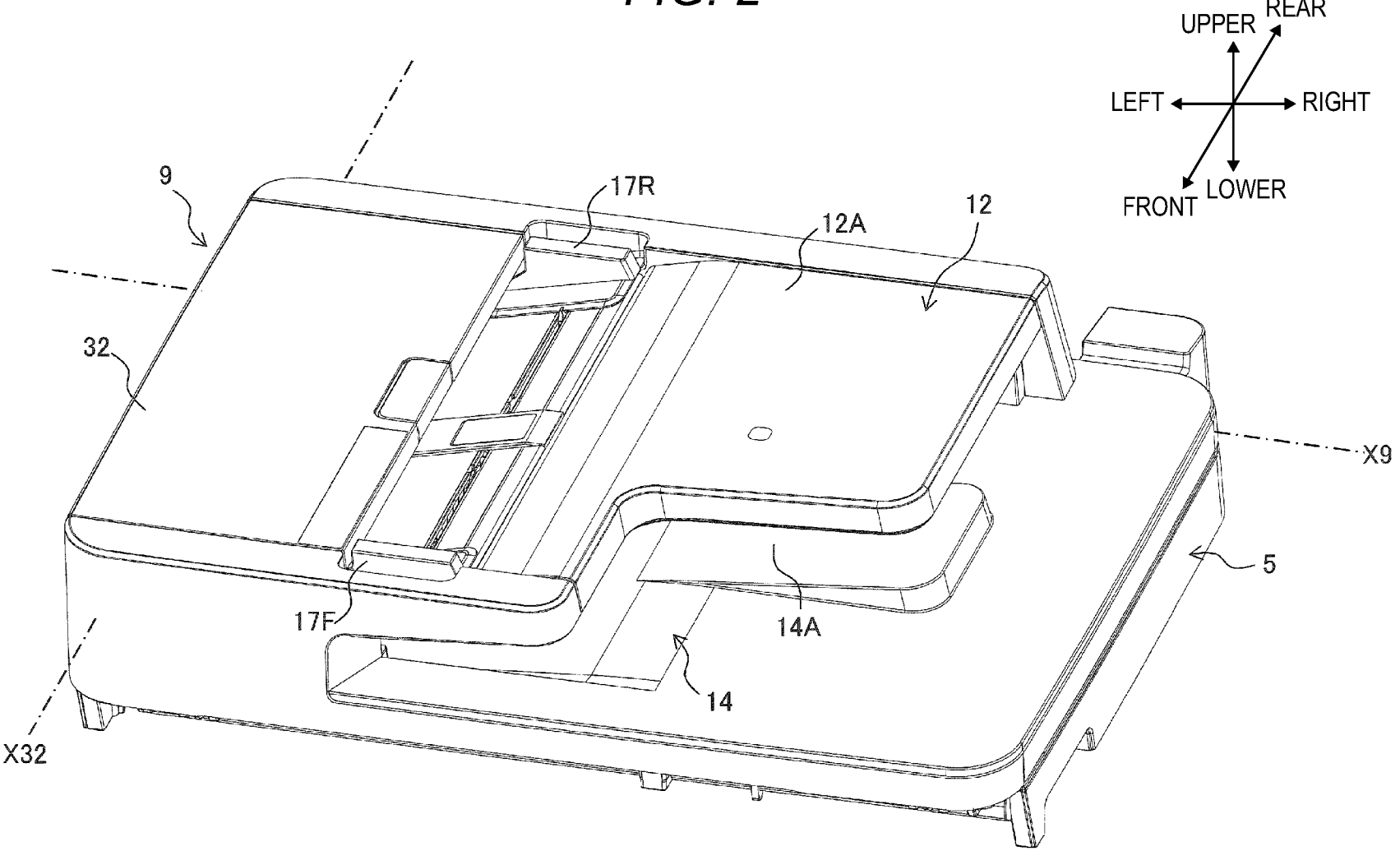
FIG. 2 is a perspective view showing an appearance configuration of the multifunction device.
Figure 3:
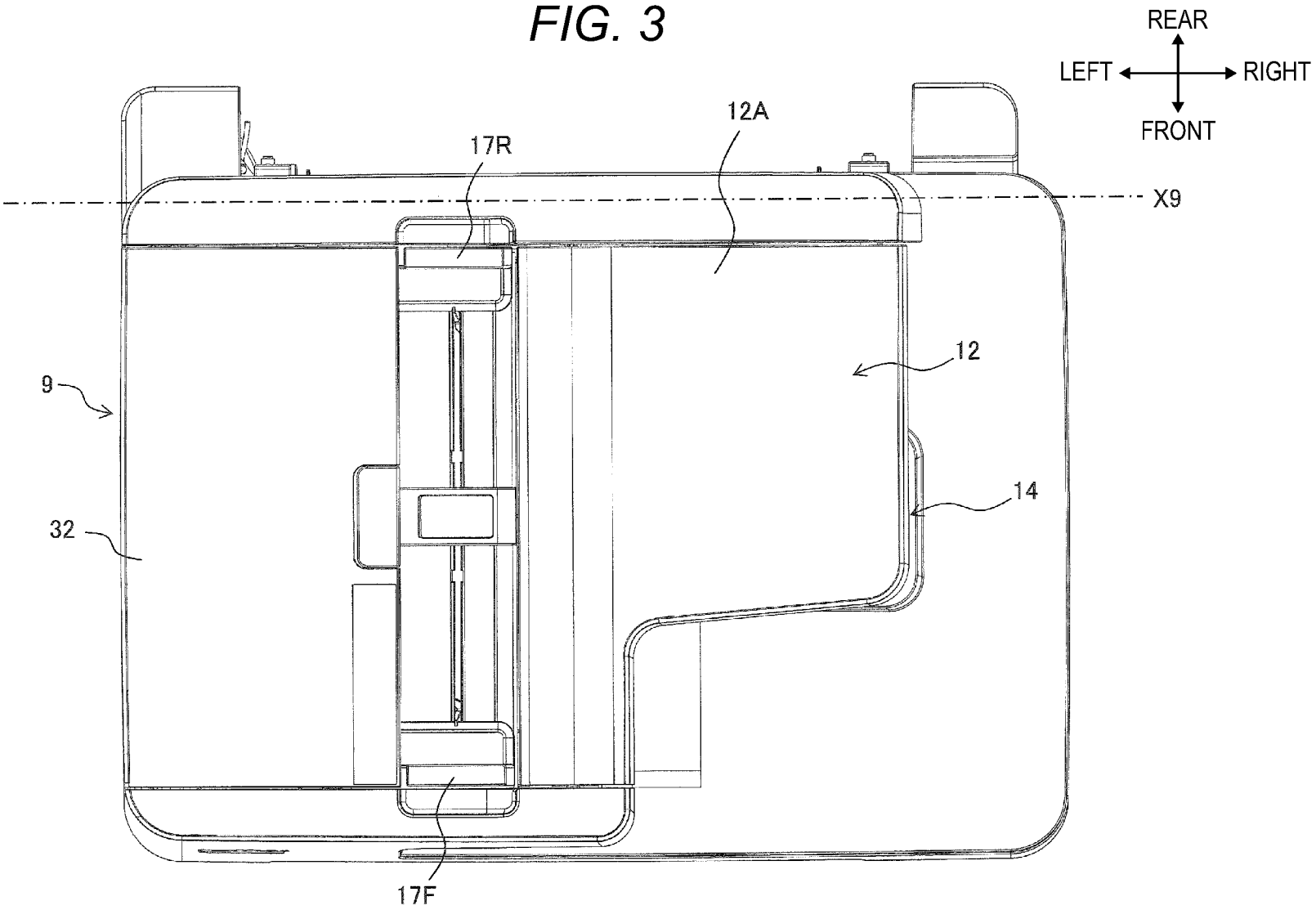
FIG. 3 is a plan view showing the appearance configuration of the multifunction device.

An appearance configuration of the ADF 9 is shown in FIGS. 2 and 3. As shown in FIGS. 2 and 3, the ADF 9 is swingably supported around an opening and closing axis X9 that extends in a left-right direction by a hinge (not shown) disposed at a rear portion. The ADF 9 covers the document support surface 101A, which will be described later, from above in a closed state shown in FIGS. 2 and 3. Although not shown, the ADF 9 exposes the document support surface 101A by being swung around the opening and closing axis X9 such that a front end portion thereof is displaced upward and rearward. Accordingly, a user can cause a document to be read to be supported on the document support surface 101A.

As shown in FIGS. 2 and 3, the supply tray 12 is formed at a right portion of the ADF 9. An upper surface of the supply tray 12 is a sheet feeding surface 12A that supports the sheets SH from below. A plurality of sheets SH to be read, which are conveyed by the conveyance unit 6, are loaded on the sheet feeding surface 12A. The sheet feeding surface 12A is a flat surface inclined downward to a left side. A front guide 17F and a rear guide 17R are provided on the supply tray 12 so as to be slidable in a front-rear direction. When the front guide 17F and the rear guide 17R approach or separate from each other, a plurality of types of sheets SH having different sizes supported by the supply tray 12 are sandwiched from front and rear sides. As shown in FIGS. 2 and 3, the discharge tray 14 is positioned below the supply tray 12. An upper surface of the discharge tray 14 is a sheet discharge surface 14A that supports the sheets SH from below. An image sensor 3S reads an image on the sheet discharge surface 14A, and the sheets SH discharged by the conveyance unit 6 are loaded on the sheet discharge surface 14A. The sheet discharge surface 14A is a flat surface inclined upward from left to right.

As shown in FIGS. 2 and 3, an opening and closing cover 32 is provided at an upper portion of the ADF 9. The opening and closing cover 32 is a substantially flat plate member that extends in front-rear and left-right directions from a substantially center to a left end of the ADF 9. A left end portion of the opening and closing cover 32 is bent downward. Then, the opening and closing cover 32 is swingably supported around an opening and closing axis X32 that extends in the front-rear direction at a left end and a lower end portion thereof. Accordingly, the opening and closing cover 32 is displaceable between a closed position indicated by solid lines in FIGS. 2 and 3 and an open position indicated in FIG. 5 and the like described later. In the closed position, the opening and closing cover 32 functions to cover the conveyance path P1.

Cross-Sectional Structure of Reader

Figure 4:
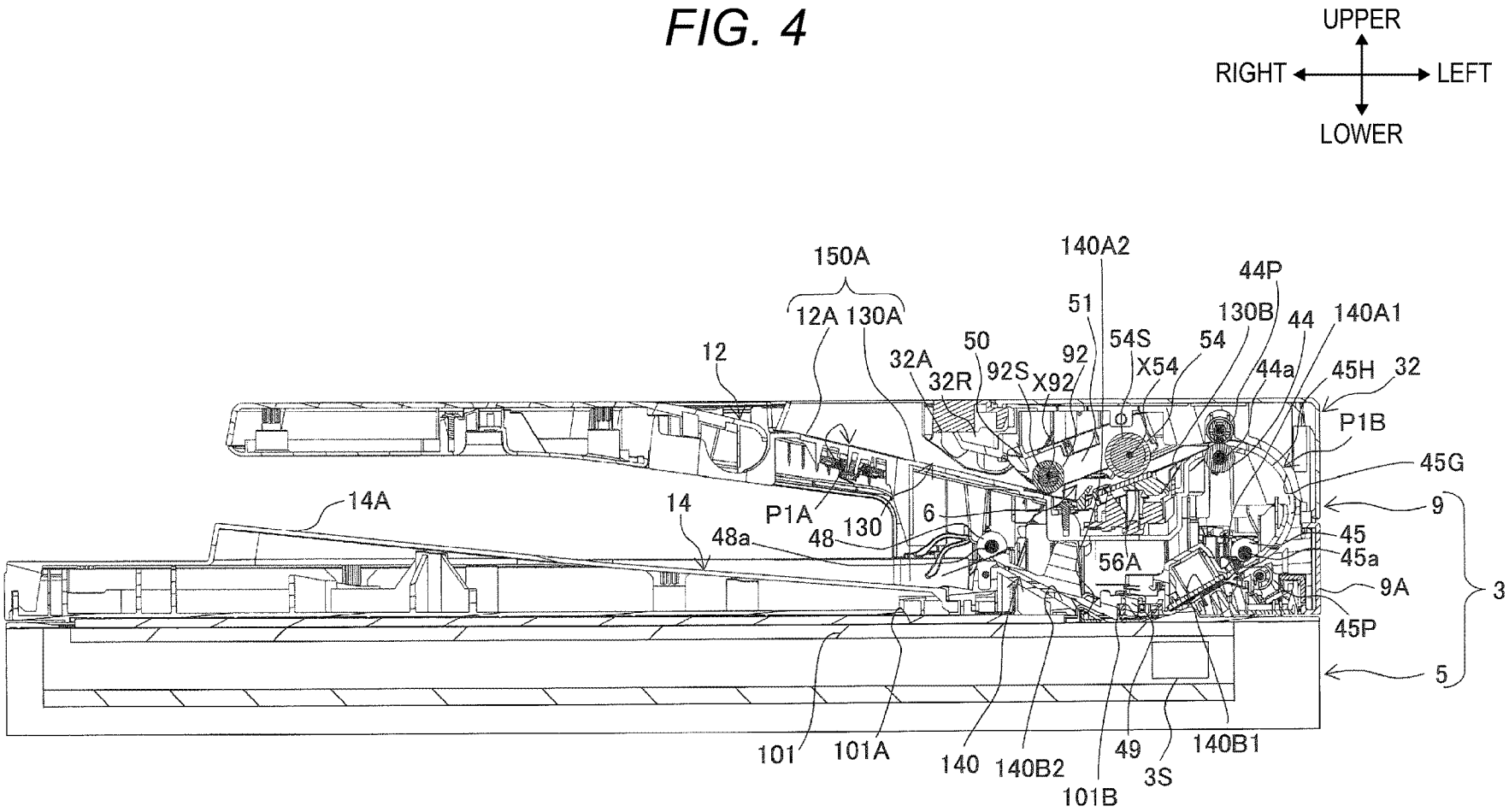
FIG. 4 is a transverse cross-sectional view of a cross-sectional structure of a main part of a reader when viewed from a rear side.
Figure 5:
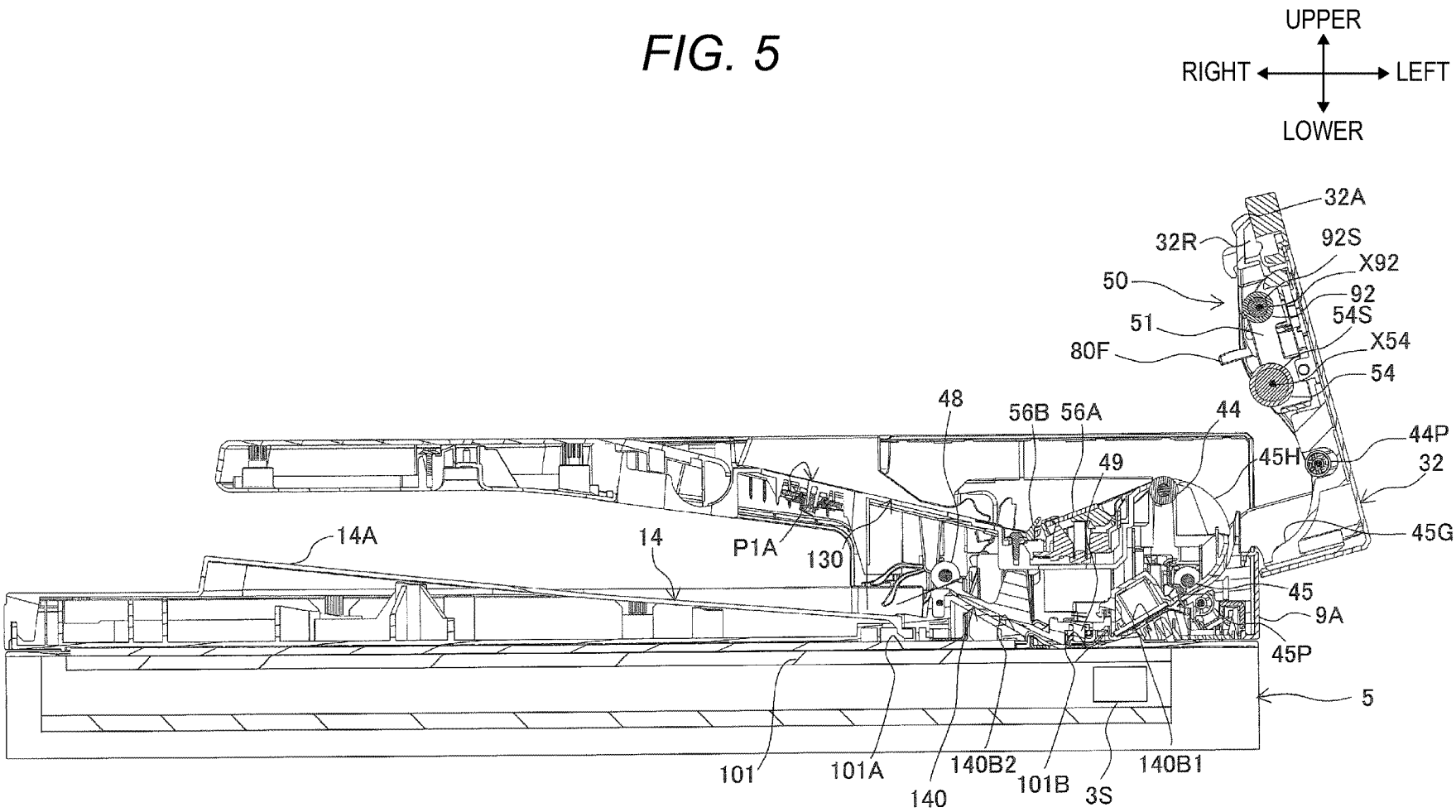
FIG. 5 is a transverse cross-sectional view showing a state where an opening and closing cover is opened in the structure shown in FIG. 4.

FIG. 4 is a diagram showing a cross-sectional structure of a main part of the reader 3 when viewed from a rear side. FIG. 5 is a diagram showing a state where the opening and closing cover 32 is opened in the cross-sectional structure. In these FIGS. 4 and 5, a platen glass 101 is disposed on an upper surface of the FB unit 5. An upper surface of the platen glass 101 forms the document support surface 101A. The image sensor 3S is provided below the platen glass 101 in the FB unit 5 so as to be movable in the left-right direction. The document support surface 101A supports the document from below when the image sensor 3S reads an image of the document in a static state.

A reading surface 101B is formed by an upper surface of the platen glass 101. The reading surface 101B guides the conveyed sheets SH from below when the image sensor 3S in the FB unit 5 reads images on the sheets SH conveyed one by one by the conveyance unit 6. In the present embodiment, an object from which an image is read using the document support surface 101A is referred to as the document, and an object from which an image is read while being conveyed by the conveyance unit 6 is referred to as the sheet SH. The document and the sheet SH may be substantially the same.

The FB unit 5 includes the image sensor 3S, a scanning mechanism (not shown), and the platen glass 101. The scanning mechanism reciprocates the image sensor 3S in the left-right direction below the document support surface 101A and the reading surface 101B. When reading an image of a document supported by the document support surface 101A, the image sensor 3S reads the image while moving below the document support surface 101A. When an image is read while the sheet SH is conveyed by the conveyance unit 6, the image sensor 3S is stopped at a predetermined static reading position. Here, the static reading position where the image sensor 3S is stopped is a position facing the reading surface 101B from below. As the image sensor 3S, a known image reading sensor such as a contact image sensor (CIS) or a charge coupled device (CCD) is used.

A base member 9A is provided at a lower portion of the ADF 9. The base member 9A constitutes a bottom portion of the ADF 9. A right portion of the base member 9A constitutes the discharge tray 14. The conveyance unit 6 is provided between the opening and closing cover 32 and a left portion of the base member 9A of the ADF 9. The conveyance unit 6 includes an upper chute member 130 and a lower chute member 140 assembled to the base member 9A. The lower chute member 140 is positioned below the upper chute member 130. The base member 9A is positioned below the lower chute member 140.

Figure 6:
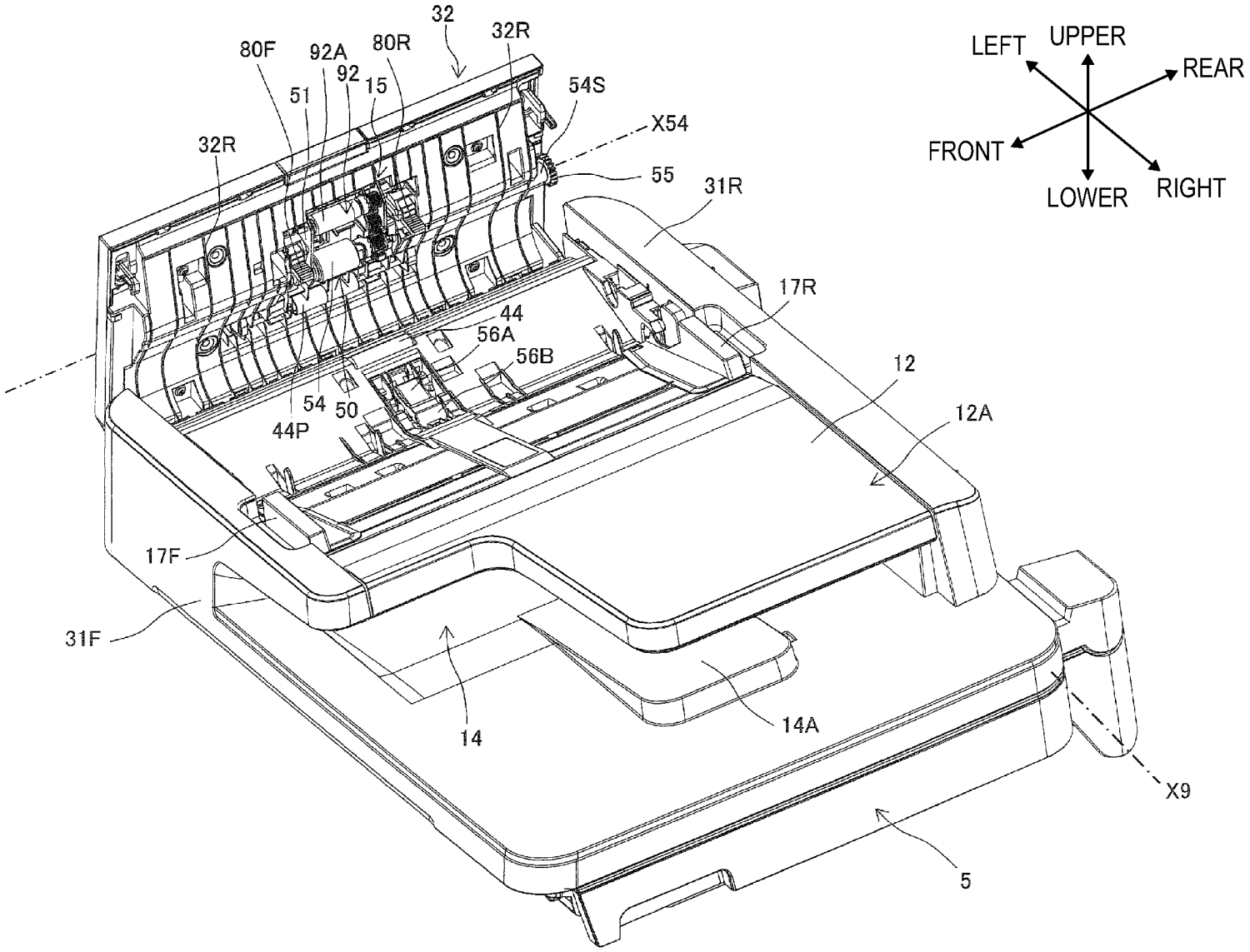
FIG. 6 is a perspective view showing a state where the opening and closing cover is opened in the structure shown in FIG. 4.

As shown in FIGS. 4, 5, and 6, a plurality of guide ribs 32R that extend in the left-right direction are formed side by side in the front-rear direction on an inner surface of the opening and closing cover 32. An upper guide surface 32A is formed by lower end edges of the guide ribs 32R. The upper guide surface 32A defines an upper path P1A, which will be described later, of the conveyance path P1 from above.

An upper surface of the upper chute member 130 is an example of a support surface, and a first upper conveying surface 130A and a second upper conveying surface 130B are formed on the upper surface of the upper chute member 130. The first upper conveying surface 130A is a flat surface that is adjacent to a left end of the supply tray 12 and is inclined downward to a left side. The first upper conveying surface 130A of the upper chute member 130 and the sheet feeding surface 12A of the supply tray 12 constitute a loading surface 150A. The plurality of sheets SH to be read, which are conveyed by the conveyance unit 6, are loaded on the loading surface 150A. The second upper conveying surface 130B is a substantially flat surface inclined upward to the left side following the first upper conveying surface 130A.

Lower guide surfaces 140A1 and 140A2 are formed on a lower surface of the lower chute member 140. The lower guide surface 140A1 is a substantially flat surface inclined downward to a right side from a vicinity of a left end portion in the ADF 9 toward the reading surface 101B. The lower guide surface 140A2 is a substantially flat surface inclined upward to the right side following the lower guide surface 140A1. An upper surface of the base member 9A is formed with a lower conveying surface 140B1 facing the lower guide surface 140A1 from below and a lower conveying surface 140B2 facing the lower guide surface 140A2 from below.

The conveyance path P1 in the conveyance unit 6 is defined as a space surrounded by the first upper conveying surface 130A and the second upper conveying surface 130B of the upper chute member 130, the lower guide surfaces 140A1 and 140A2 of the lower chute member 140, the upper guide surface 32A of the opening and closing cover 32, the lower conveying surfaces 140B1 and 140B2 of the base member 9A, various conveyance rollers, and the like. More specifically, the conveyance path P1 includes the upper path P1A that is a portion that extends to the left side along the first upper conveying surface 130A and the second upper conveying surface 130B of the upper chute member 130 from the sheet feeding surface 12A of the supply tray 12. Next, the conveyance path P1 includes a curved path P1B that is a portion connected to the upper path P1A and curved downward. Next, the conveyance path P1 includes a lower path P1C that is connected to the curved path P1B, and that includes a portion that is inclined downward from a lower end of a curved portion toward the reading surface 101B and then extends short to the right side along the reading surface 101B and a portion that is inclined upward from a right end of the reading surface 101B toward a further right side and reaches the discharge tray 14. The upper path P1A and the lower path P1C overlap each other in an upper-lower direction. A conveying direction of the sheets SH conveyed by the conveyance unit 6 is leftward in the upper path P1A of the conveyance path P1, is changed from leftward to rightward in the curved path P1B of the conveyance path P1, and is rightward in the lower path P1C of the conveyance path P1. The extending direction and a shape of the conveyance path P1 are examples.

Separation Roller, Separation Pad, Sheet Feeding Roller, Etc.

As shown in FIGS. 4, 5, and 6, the conveyance unit 6 includes a separation unit 50, a separation pad 56A, and a separation bank 56B. Although the details will be described later, the separation unit 50 includes a separation roller 54 including a rotation shaft 54S, a holder 51, and a sheet feeding roller 92 including a rotation shaft 92S. The rotation shaft 54S is an example of a driving shaft of a separation roller, and the rotation shaft 92S is an example of a driving shaft of a sheet feeding roller.

The separation roller 54 is positioned leftward of the sheet feeding roller 92, that is, downstream of the conveyance path P1 in the conveying direction. Then, the separation roller 54 is provided at a position facing the second upper conveying surface 130B of the upper chute member 130 from above. The rotation shaft 54S of the separation roller 54 is a columnar shaft body that extends around a rotation axis X54 that extends in the front-rear direction, which is a direction orthogonal to the conveying direction of the sheets SH. As shown in FIG. 6, a front end and a rear end of the rotation shaft 54S of the separation roller 54 are respectively rotatably supported by a front cover 31F that forms a front end portion of the ADF 9 and a frame (not shown) disposed inside a rear cover 31R that forms a rear end of the ADF 9. The separation roller 54 is assembled to a central portion of the rotation shaft 54S.

As shown in FIG. 4, the separation pad 56A forms a conveying surface of the sheets SH together with the second upper conveying surface 130B. The separation pad 56A is provided at a position facing the separation roller 54 from below. The separation pad 56A is a plate-shaped body made of a soft material such as rubber or elastomer. The separation pad 56A is pressed toward the separation roller 54 by, for example, an urging spring (not shown).

As shown in FIGS. 5 and 6, the separation bank 56B is provided between the sheet feeding roller 92 and the separation roller 54 in the conveyance path P1. The separation bank 56B includes an abutment surface 56B1 (see FIG. 15 described later) for separating an uppermost one of the plurality of sheets SH when the plurality of sheets SH are fed by the sheet feeding roller 92.

As shown in FIGS. 4, 5, and 6, the holder 51 houses the separation roller 54 while covering the separation roller 54 from above and sandwiching the separation roller 54 from front and rear sides. Details will be described later. The holder 51 is supported by the rotation shaft 54S so as to be swingable around the rotation axis X54 of the separation roller 54. Further, the holder 51 extends rightward with respect to the rotation shaft 54S, that is, toward an upstream side in the conveying direction.

As shown in FIGS. 4, 5, and 6, the sheet feeding roller 92 is provided at a position facing the first upper conveying surface 130A of the upper chute member 130 from above. Then, the sheet feeding roller 92 is contactable with the sheets SH loaded on the loading surface 150A from above. The sheet feeding roller 92 is positioned on a right side of the separation roller 54 and is housed in the holder 51. The sheet feeding roller 92 is supported by the holder 51 so as to be rotatable around a rotation axis X92 parallel to the rotation axis X54. Therefore, when the holder 51 swings upward or downward around the rotation axis X54 of the separation roller 54, the sheet feeding roller 92 is configured to be displaceable between a position close to the loading surface 150A and a position away from the loading surface 150A.

As shown in FIG. 6, a transmission gear 55 is provided at a rear end of the rotation shaft 54S. The transmission gear 55 rotates the rotation shaft 54S by driving a motor 70 described later. When the transmission gear 55 is rotated, the rotation shaft 54S is rotated, and the separation roller 54 and the sheet feeding roller 92 are rotated in synchronization with each other. An outer peripheral surface 92A of the sheet feeding roller 92 applies a conveying force to a sheet SH at an uppermost position among the sheets SH loaded on the loading surface 150A, and feeds the sheet SH toward the separation roller 54. As shown in FIGS. 4, 5, and 6, the separation roller 54 cooperates with the separation bank 56B and the separation pad 56A to separate the sheets SH conveyed by the sheet feeding roller 92 one by one, and to convey the sheets SH downstream in the conveying direction in the conveyance path P1. The separation roller 54, the separation pad 56A, and the separation bank 56B are each an example of "a separation member" of the present disclosure.

Conveyance Roller

As shown in FIGS. 4, 5, and 6, the conveyance unit 6 includes a first conveyance roller 44 and a pinch roller 44P in the upper path NA of the conveyance path P1 at positions leftward of the separation roller 54, that is, at positions downstream of the separation roller 54 in the conveying direction. The first conveyance roller 44 and the pinch roller 44P nip the sheet SH separated one by one by the separation roller 54, the separation bank 56B, and the separation pad 56A, and convey the sheet SH toward a downstream side in the conveying direction.

As shown in FIGS. 4 and 5, the conveyance unit 6 includes a curved guide surface 45G, a curved guide surface 45H, a second conveyance roller 45, and a pinch roller 45P in the curved path P1B of the conveyance path P1. The curved guide surface 45G and the curved guide surface 45H face each other with a predetermined interval therebetween. The curved guide surface 45G defines a portion that curves downward in the curved path P1B from an outside. The curved guide surface 45H defines a portion that curves downward in the curved path P1B from an inside. The second conveyance roller 45 and the pinch roller 45P are arranged at a lower end portion of the curved path P1B. The second conveyance roller 45 and the pinch roller 45P nip the sheet SH conveyed by the first conveyance roller 44 and the pinch roller 44P, and further convey the sheet SH toward the reading surface 101B. A left portion of the lower path P1C is defined by the lower guide surface 140A1 and the lower conveying surface 140B1 facing each other at a predetermined interval between the first conveyance roller 44 as well as the pinch roller 44P and the reading surface 101B.

As shown in FIGS. 4 and 5, the conveyance unit 6 further includes a sheet discharge roller 48 and a pinch roller (not shown). A right portion of the lower path P1C is defined by the lower guide surface 140A2 and the lower conveying surface 140B2 facing each other at a predetermined interval between the reading surface 101B and the sheet discharge roller 48 as well as the pinch roller.

A path formed by the lower guide surface 140A2 and the lower conveying surface 140B2 is inclined upward toward the sheet discharge roller 48 and the pinch roller on a right side of a pressing member 49. The sheet discharge roller 48 includes a driving shaft 48*a*, and is positioned at a right end portion of the lower guide surface 140A2 of the lower chute member 140. The pinch roller is positioned at a right end portion of the lower conveying surface 140B2. The sheet discharge roller 48 and the pinch roller nip the sheet SH that has passed over the reading surface 101B, and discharge the sheet SH toward the sheet discharge surface 14A of the discharge tray 14.

Regulating Member

As shown in FIGS. 5 and 6, the ADF 9 according to the present embodiment includes a pair of front and rear regulating members 80F and 80R that are positioned between the separation roller 54 and the sheet feeding roller 92 and abut against a distal end of the sheet SH in the conveying direction to regulate a movement of the sheet SH. Hereinafter, as appropriate, the front regulating member 80F and the rear regulating member 80R are collectively referred to simply as "regulating member 80". The regulating member 80 may also be referred to as stopper.

Figure 7A:
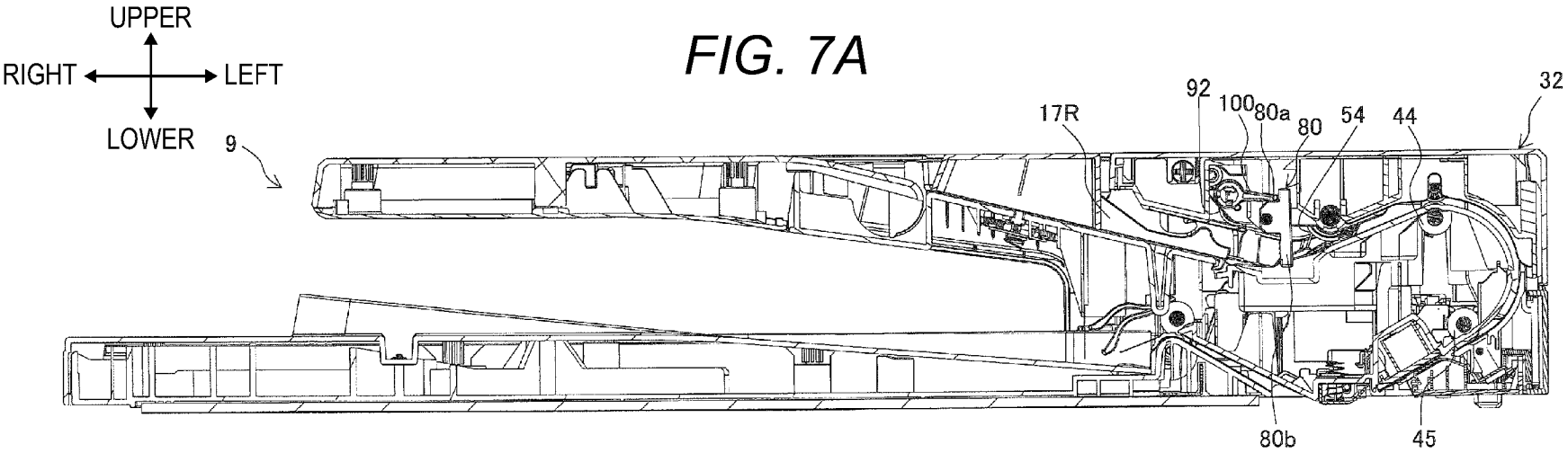
FIG. 7A is a cross-sectional view showing a state where a regulating member is engaged with a lock lever.
Figure 7B:
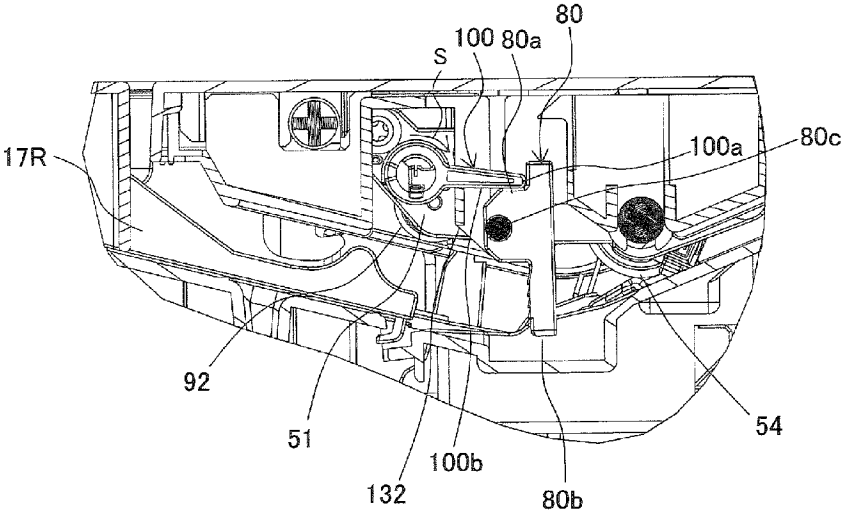
FIG. 7B is a partially enlarged view thereof.
Figure 8A:
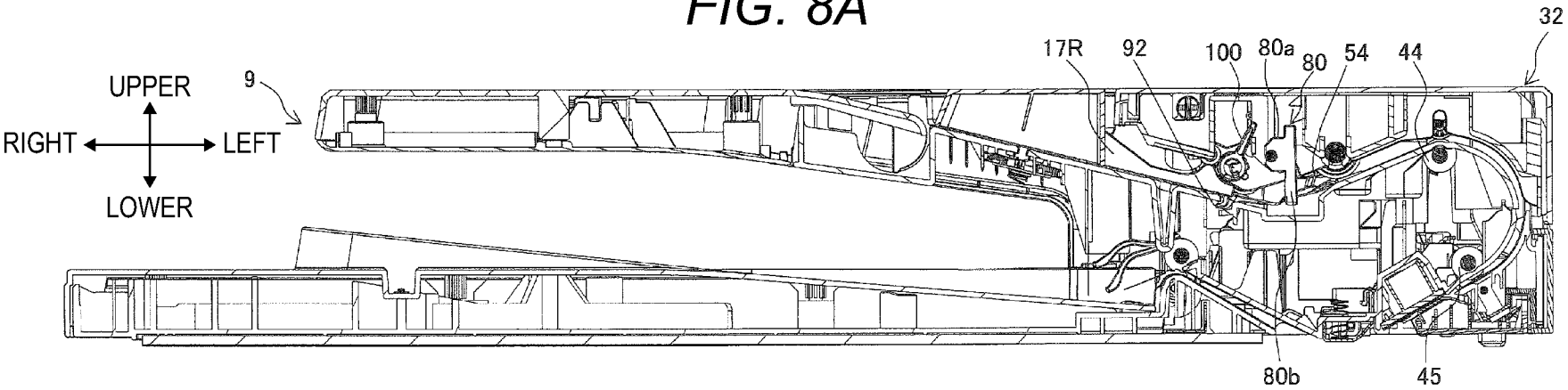
FIG. 8A is a cross-sectional view showing a state where the engagement between the regulating member and the lock lever is released.
Figure 8B:
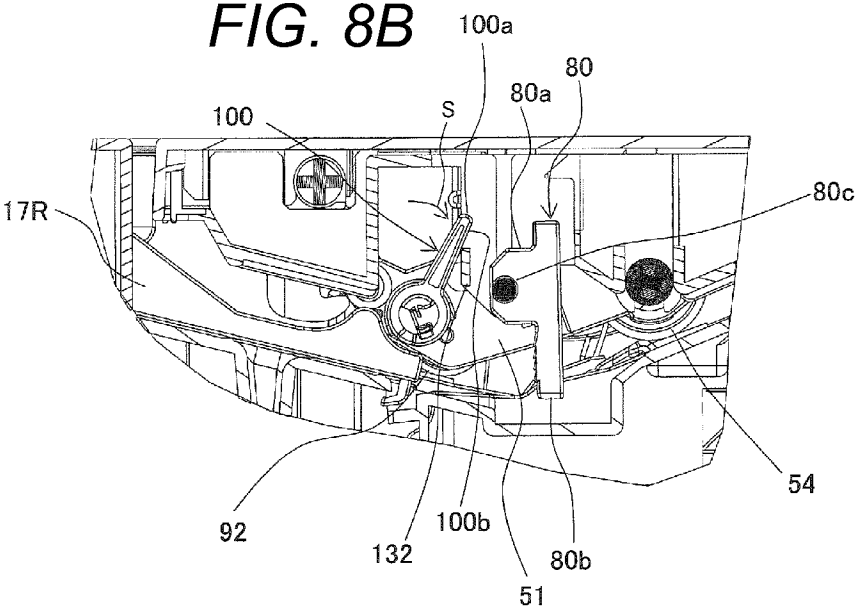
FIG. 8B is a partially enlarged view thereof.

The regulating member 80 is configured such that a position can be switched between a regulated state shown in FIGS. 7A and 7B and a regulation release state shown in FIGS. 8A and 8B. In this example, in the regulated state, the regulating member 80 protrudes toward the first upper conveying surface 130A that defines the conveyance path P1 of the sheet SH by being engaged with a lock lever 100 as described later, thereby regulating passage of the sheet SH. A position of the regulating member 80 at this time is an example of a first position. Further, in the regulation release state, the regulating member 80 is released from the engagement by the lock lever 100 and is in a free state as described later, so that the regulating member 80 is pushed by a distal end of the sheet SH, is rotated from the first position, retracts upward so as to be away from the first upper conveying surface 130A, and allows the sheet SH to move to a downstream side, that is, allows passage of the sheet SH. A position of the regulating member 80 at this time is an example of a second position farther from the conveyance path P1 than the first position. The regulating member 80 is supported by the opening and closing cover 32 together with the holder 51 including the separation roller 54 and the sheet feeding roller 92.

Switching Mechanism

A state of the regulating member 80 is switched by using transmission of the driving force to the separation roller 54. Hereinafter, details thereof will be described with reference to FIGS. 7A to 11C described above.

Figure 9:
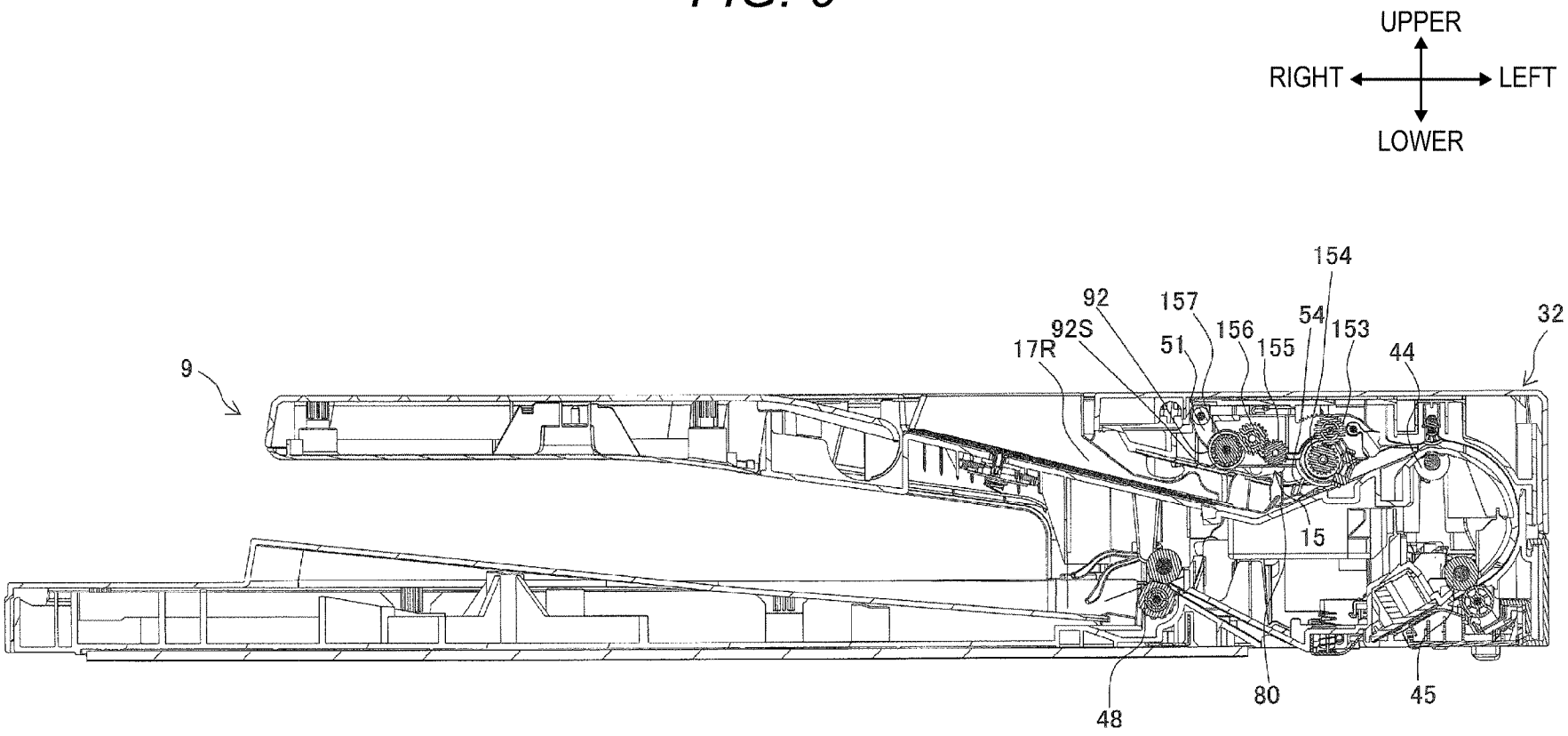
FIG. 9 is a transverse cross-sectional view for illustrating a configuration for transmitting a driving force from a motor to a sheet feeding roller.

In FIG. 9, as described above, the separation roller 54 and the sheet feeding roller 92 are provided in the holder 51, and the holder 51 is swingably supported by the rotation shaft 54S of the separation roller 54. The holder 51 is further provided with a shaft gear 154 fixed to the rotation shaft 54S, a planetary gear 153 that meshes with the shaft gear 154 and is movable by meshing with fixed teeth 32*a* provided on the opening and closing cover 32, an intermediate gear 156 that meshes with a shaft gear 157 fixed to the rotation shaft 92S of the sheet feeding roller 92, and an intermediate gear 155 that meshes with the intermediate gear 156. The shaft gear 154, the planetary gear 153, the intermediate gears 155 and 156, and the shaft gear 157 constitute a gear mechanism 15 that transmits the driving force input from the motor 70 to the rotation shaft 54S of the separation roller 54 to the rotation shaft 92S of the sheet feeding roller 92.

Figure 10A:
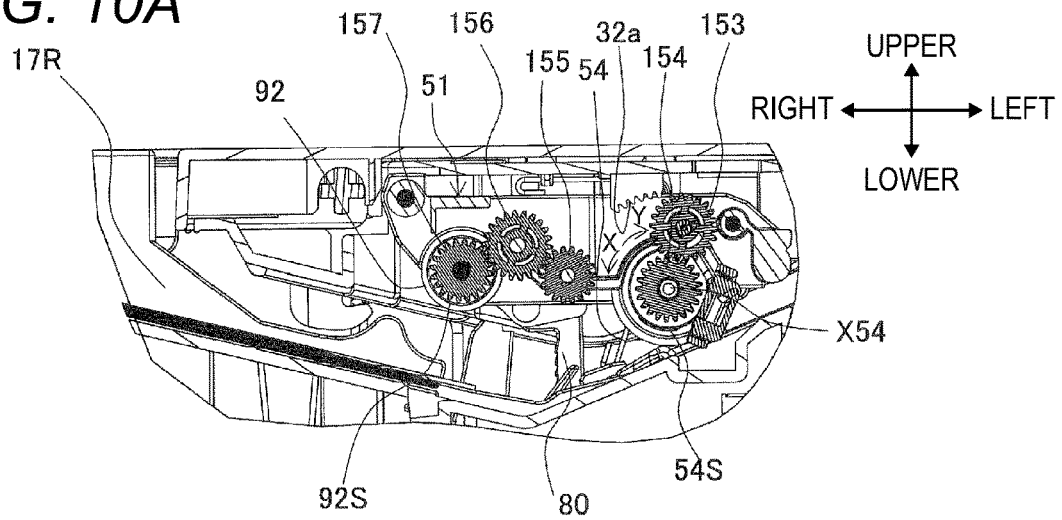
FIGS. 10A to 10C are partially enlarged cross-sectional views for illustrating transmission and blocking of the driving force because of movement of a planetary gear and a swing of a holder.
Figure 10B:
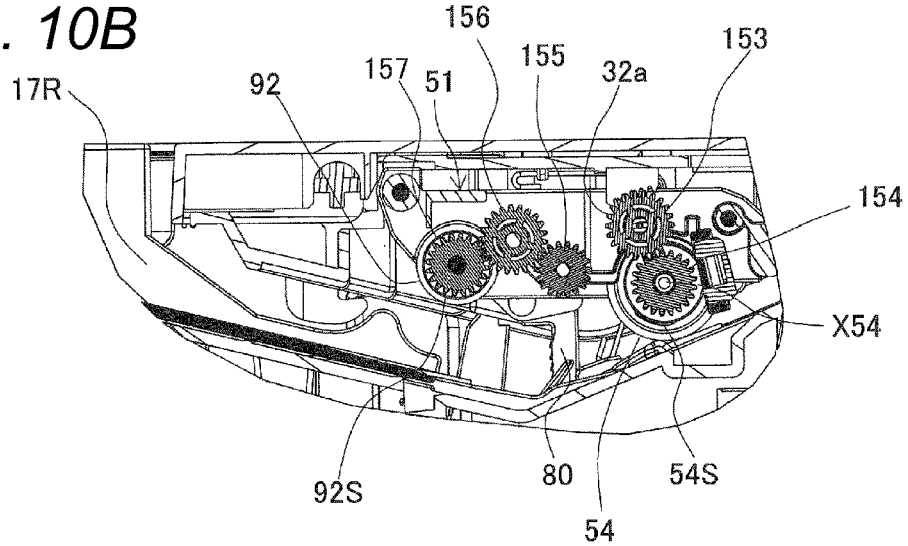
Figure 10C:
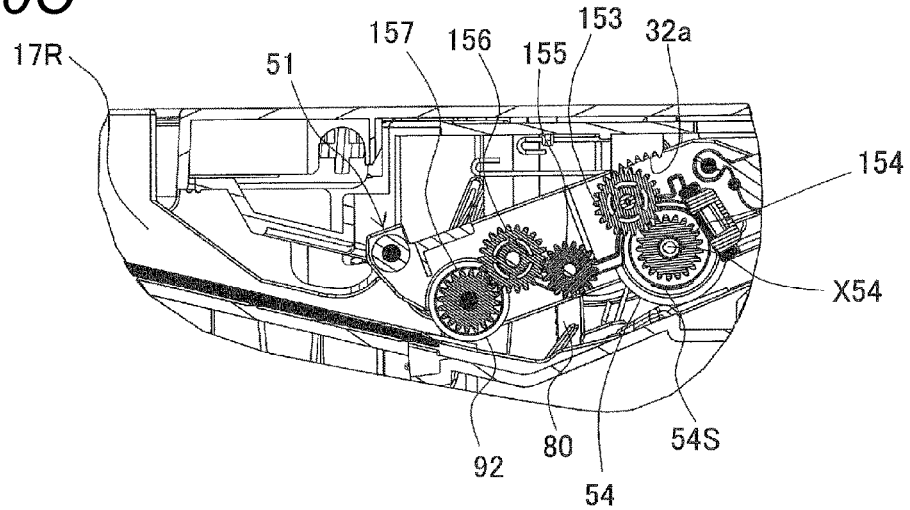

As described above, when the driving force accompanying the rotation of the motor 70 is input to the rotation shaft 54S and the rotation shaft 54S is rotated in the X direction in FIG. 10A, the planetary gear 153 is moved to an upstream side in the conveying direction and meshes with the fixed teeth 32*a* as shown in FIG. 10B. When the rotation shaft 54S is further rotated in the X direction in the meshed state, the holder 51 is swung around the rotation axis X54 such that a sheet feeding roller 92 side is lowered as shown in FIG. 10C. Accordingly, the sheet feeding roller 92 abuts against the sheet SH.

As described above with reference to FIGS. 7A to 8B, the regulating member 80 is provided in the vicinity of the holder 51 in the opening and closing cover 32. The regulating member 80 is rotatably supported by the opening and closing cover 32 with a shaft member 80*c* as a center of rotation, and includes a stepped portion 80*a* and a sheet regulating portion 80*b*. The lock lever 100 is rotatably supported in the vicinity of the sheet feeding roller 92 in the holder 51. The lock lever 100 is biased in an S direction shown in FIGS. 7B and 8B by an appropriate spring member (not shown). As shown in FIGS. 9, 10A, and 10B, in a state before the holder 51 is swung such that the sheet feeding roller 92 side is lowered as described above, a distal end portion 100*a* of the lock lever 100 abuts against and engages with the stepped portion 80*a* as shown in FIGS. 7A and 7B. As a result, the rotation of the regulating member 80 is prevented, and the regulated state is established.

When the holder 51 is rotated around the rotation axis X54 of the rotation shaft 54S in conjunction with a movement of the planetary gear 153 as described above and the holder 51 is swung such that the sheet feeding roller 92 side is lowered as shown in FIG. 10C, an abutted surface 100*b* of the lock lever 100 abuts against an abutment rib 132 provided on the opening and closing cover 32. Accordingly, the lock lever 100 is displaced so as to rotate in a direction opposite to the S direction as shown in FIGS. 8A and 8B. As a result, the engagement between the distal end portion 100*a* of the lock lever 100 and the stepped portion 80*a* is released, and the regulating member 80 is in a freely rotatable state, that is, in the regulation release state. The holder 51, the lock lever 100, and the abutment rib 132 are examples of the switching mechanism.

Figure 11A:
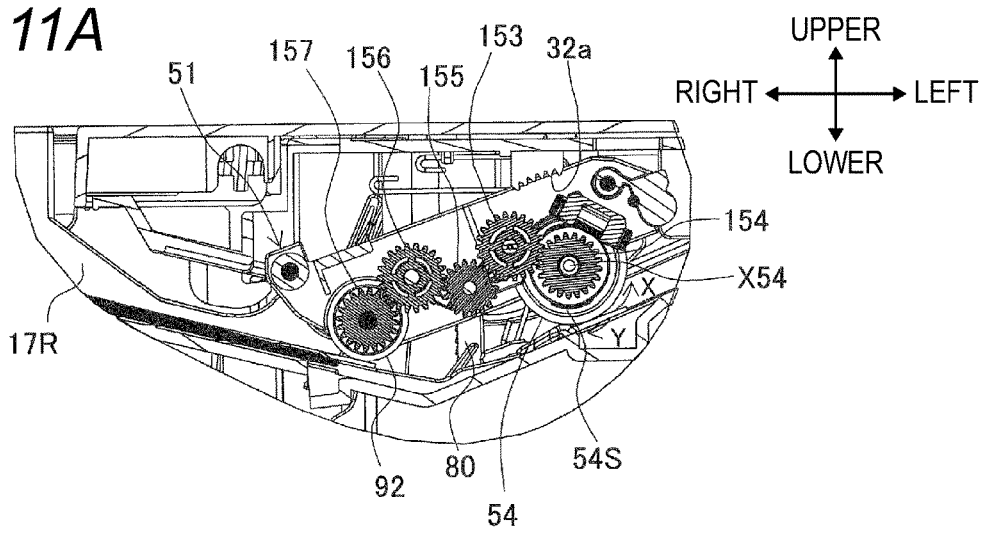
FIGS. 11A to 11C are partially enlarged cross-sectional views for illustrating the transmission and the blocking of the driving force because of movement of the planetary gear and a swing of the holder.

After the state shown in FIG. 10C, the planetary gear 153 is further moved to the upstream side in the conveying direction, so that the meshing between the planetary gear 153 and the fixed teeth 32*a* is released as shown in FIG. 11A. The planetary gear 153 released from the fixed teeth 32*a* meshes with the intermediate gear 155 as shown in FIG. 11A. Accordingly, the driving force from the motor 70 is transmitted to the shaft gear 157 via the rotation shaft 54S, the planetary gear 153, the intermediate gear 155, and the intermediate gear 156, and the sheet feeding roller 92 is rotated to convey the sheet SH to the curved path P1B.

Figure 11B:
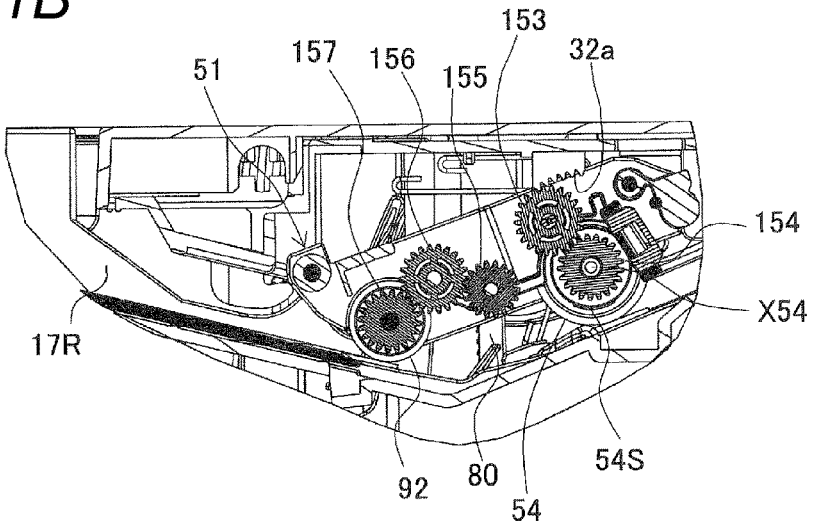
Figure 11C:
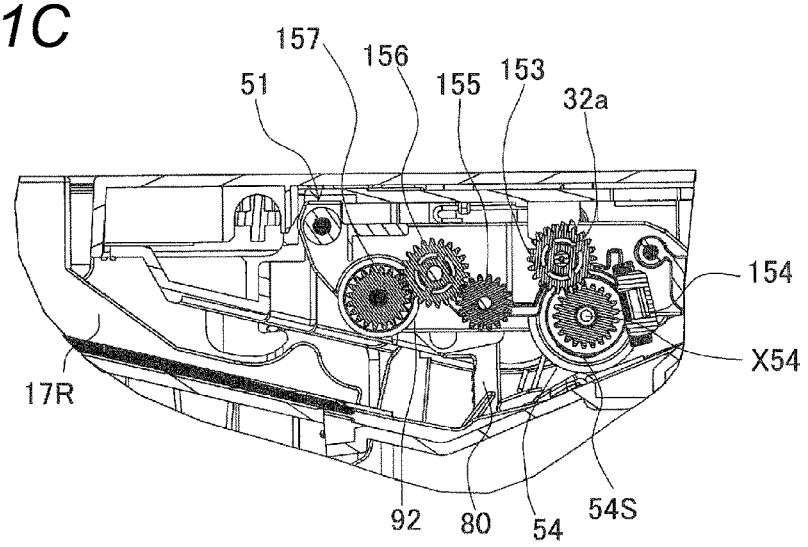

On the other hand, when the driving force accompanying the rotation of the motor 70 is input to the rotation shaft 54S and the rotation shaft 54S is rotated in the Y direction in FIG. 11A, the planetary gear 153 is moved to a downstream side in the conveying direction opposite to the above, and the meshing with the intermediate gear 155 is released. Accordingly, the transmission of the driving force from the motor 70 to the sheet feeding roller 92 is blocked. Thereafter, the planetary gear 153 is further moved and meshes with the fixed teeth 32*a* as shown in FIG. 11B. When the rotation shaft 54S is further rotated in the Y direction in the meshed state, the holder 51 is swung around the rotation axis X54 such that the sheet feeding roller 92 side is raised as shown in FIG. 11C. Accordingly, the sheet feeding roller 92 is separated from the sheet SH.

When the holder 51 is swung such that the sheet feeding roller 92 side is raised in conjunction with the movement of the planetary gear 153 as described above, the lock lever 100, which is lifted by the abutted surface 100*b* abutting against the abutment rib 132 as described above with reference to FIGS. 8A and 8B, is displaced so as to rotate in the S direction as shown in FIGS. 7A and 7B. As a result, the distal end portion 100*a* of the lock lever 100 and the stepped portion 80*a* are engaged with each other, and the regulating member 80 is in the regulated state.

Electrical Configuration of Multifunction Device

Figure 12:
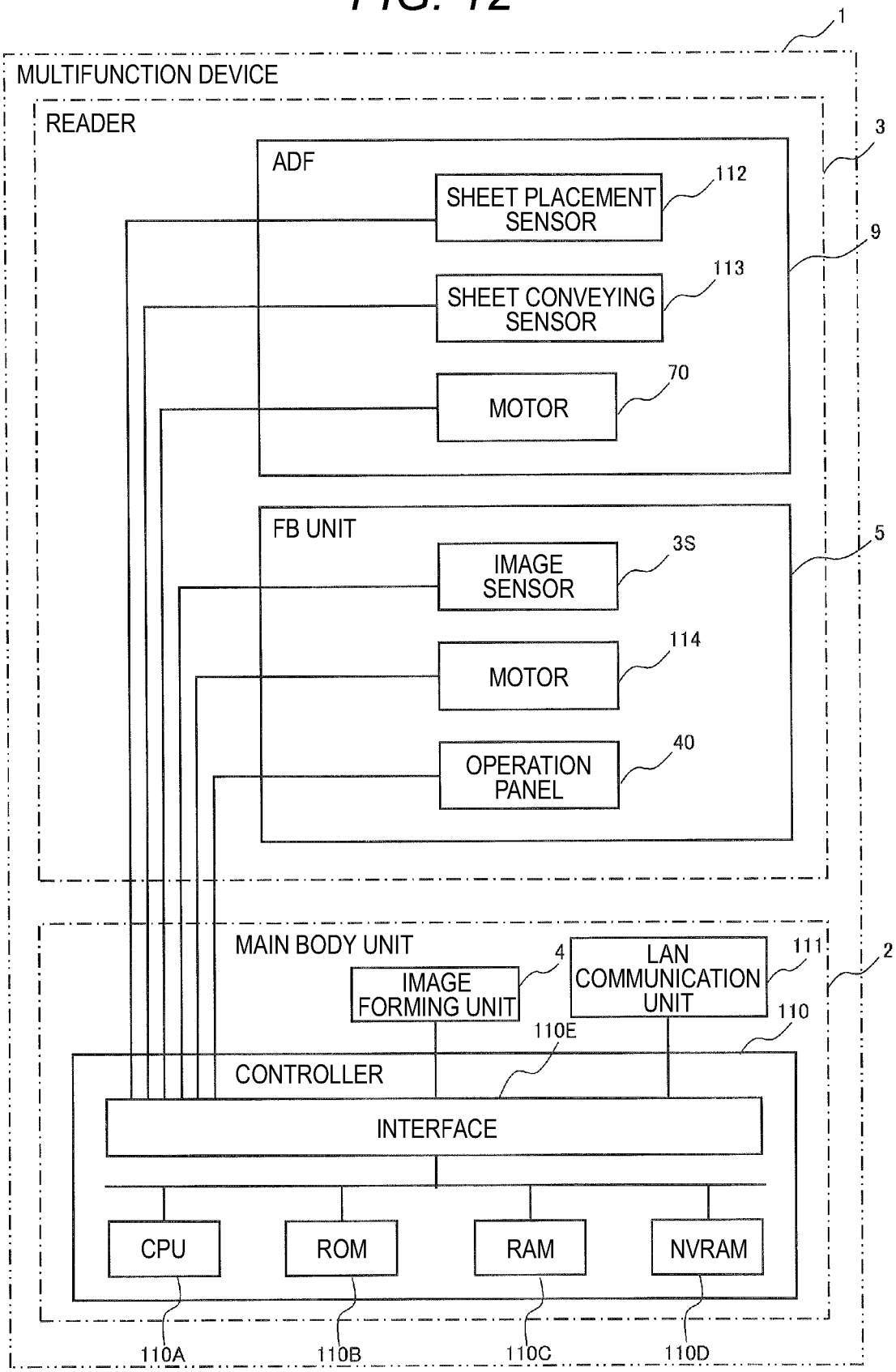
FIG. 12 is a functional block diagram showing an electrical configuration of the multifunction device.

Next, an electrical configuration of the multifunction device 1 according to the present embodiment will be described. As shown in FIG. 12, the main body unit 2 of the multifunction device 1 is provided with the controller 110. The controller 110 includes a known CPU 110A, a ROM 110B, a RAM 110C, an NVRAM 110D, an interface unit 110E, and the like. The CPU 110A executes a predetermined processing in accordance with a control program stored in the ROM 110B, the RAM 110C, or the like. Accordingly, control is executed for units of the multifunction device 1.

Control targets of the controller 110 include the image forming unit 4, a LAN communication unit 111, the operation panel 40, the image sensor 3S, a sheet conveying sensor 113, the motor 70, a motor 114, a sheet placement sensor 112, and the like. Among the above units, the image forming unit 4 and the LAN communication unit 111 are provided in the main body unit 2. The operation panel 40, the image sensor 3S, and the motor 114 are provided in the FB unit 5. The sheet placement sensor 112, the motor 70, and the sheet conveying sensor 113 are provided in the ADF 9.

The controller 110 monitors signals from the sheet placement sensor 112 and the LAN communication unit 111. The LAN communication unit 111 includes a communication interface device corresponding to a wireless LAN and a communication interface device corresponding to a wired LAN. The motor 114 is a power source for moving the image sensor 3S in a left-right direction in the FB unit 5. The sheet placement sensor 112 is a sensor that detects that the sheet SH is placed on the loading surface 150A. The sheet conveying sensor 113 is a sensor that detects that a distal end in the conveying direction and a rear end in the conveying direction of the sheet SH conveyed in the ADF 9 have passed a predetermined detection position in the conveyance path P1.

PRESENT EMBODIMENT

Details of a structure of the regulating member 80, a structure of ribs that constitute the first upper conveying surface 130A and the second upper conveying surface 130B, and an arrangement mode of the sheet placement sensor 112 in the present embodiment will be described.

Figure 13:
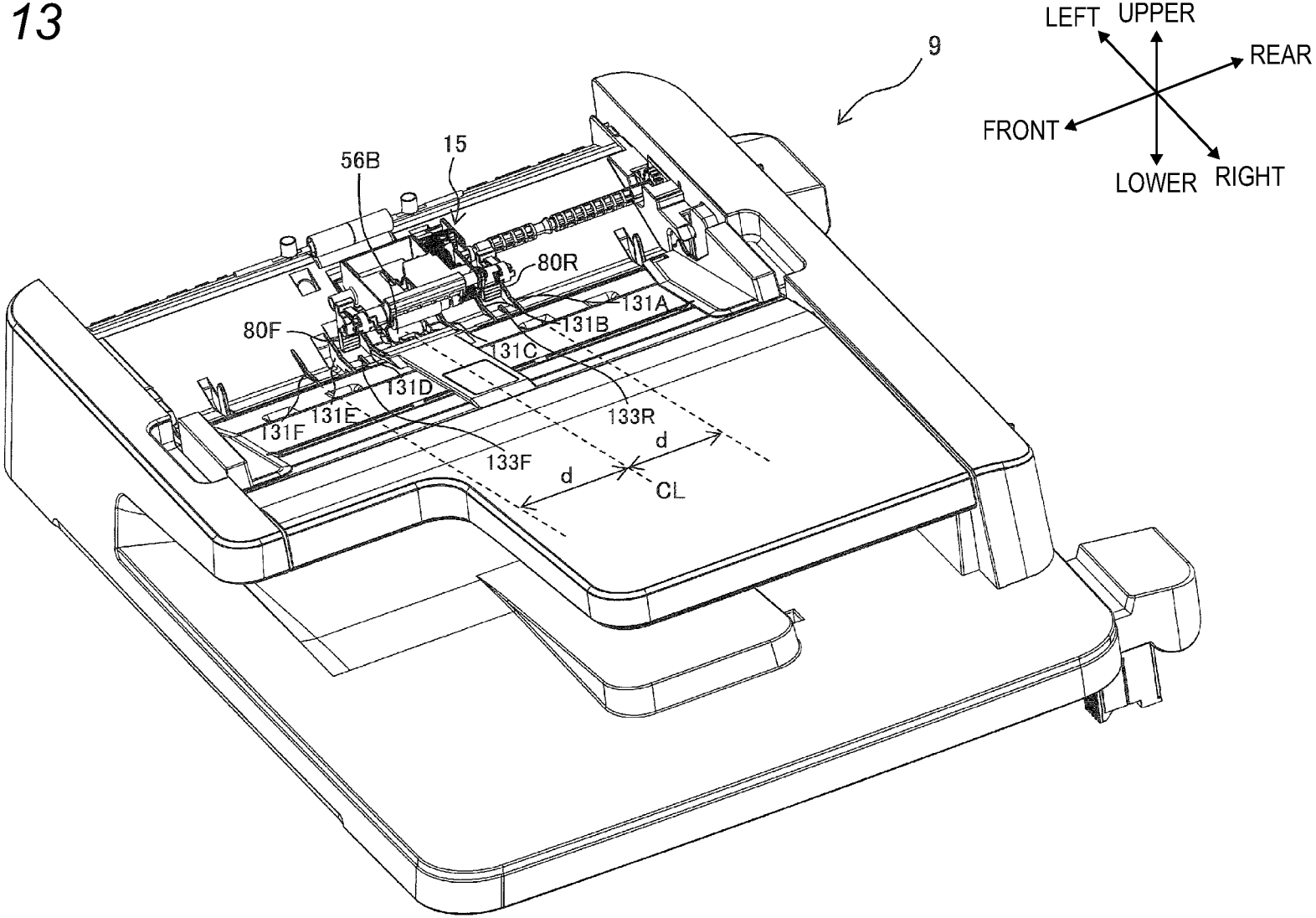
FIG. 13 is a perspective view showing an appearance configuration of an ADF with components other than a peripheral structure of the regulating member in a conveyance unit omitted.
Figure 14:
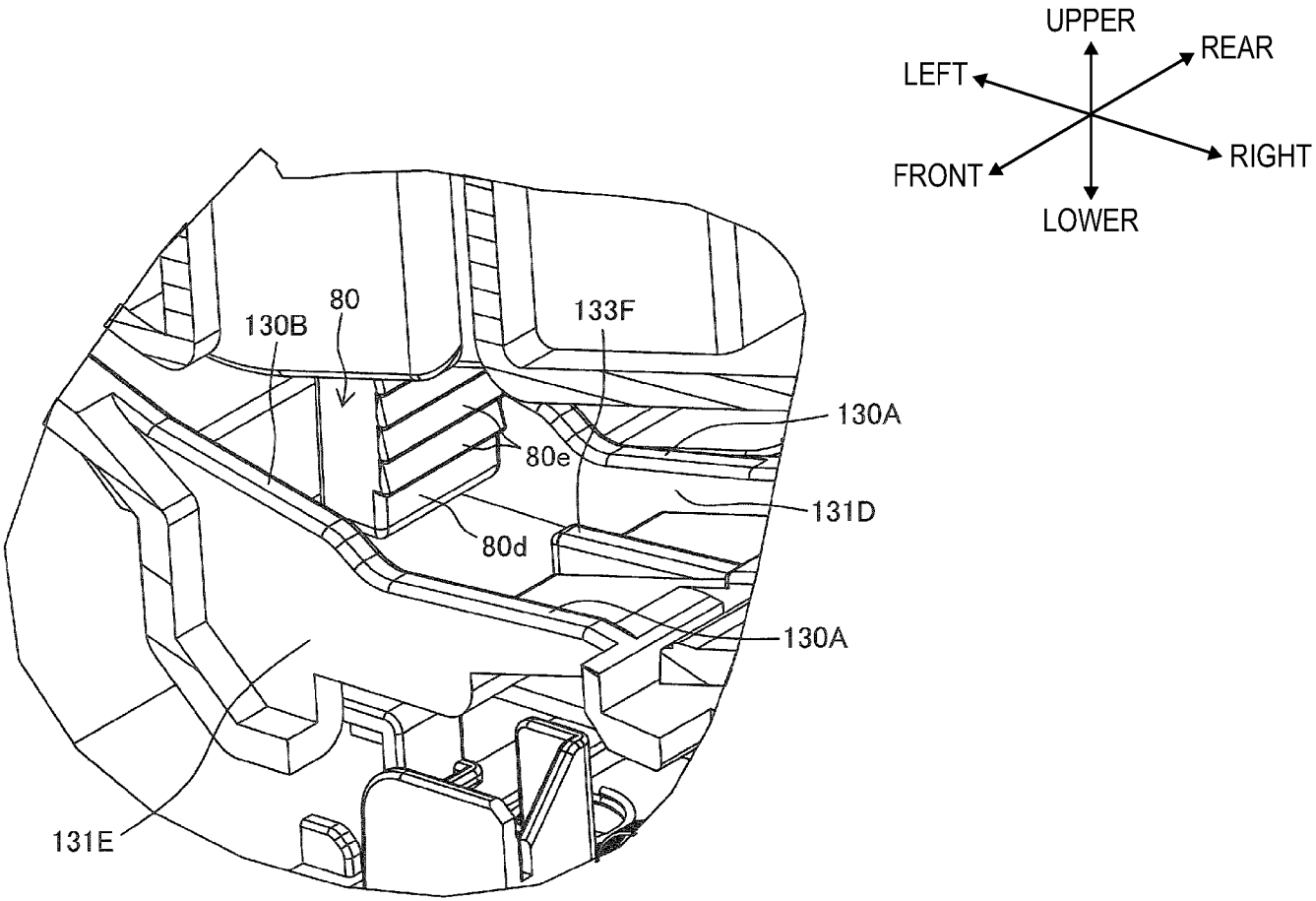
FIG. 14 is a partially enlarged perspective view showing an appearance configuration of the regulating member and a rib.
Figure 15:
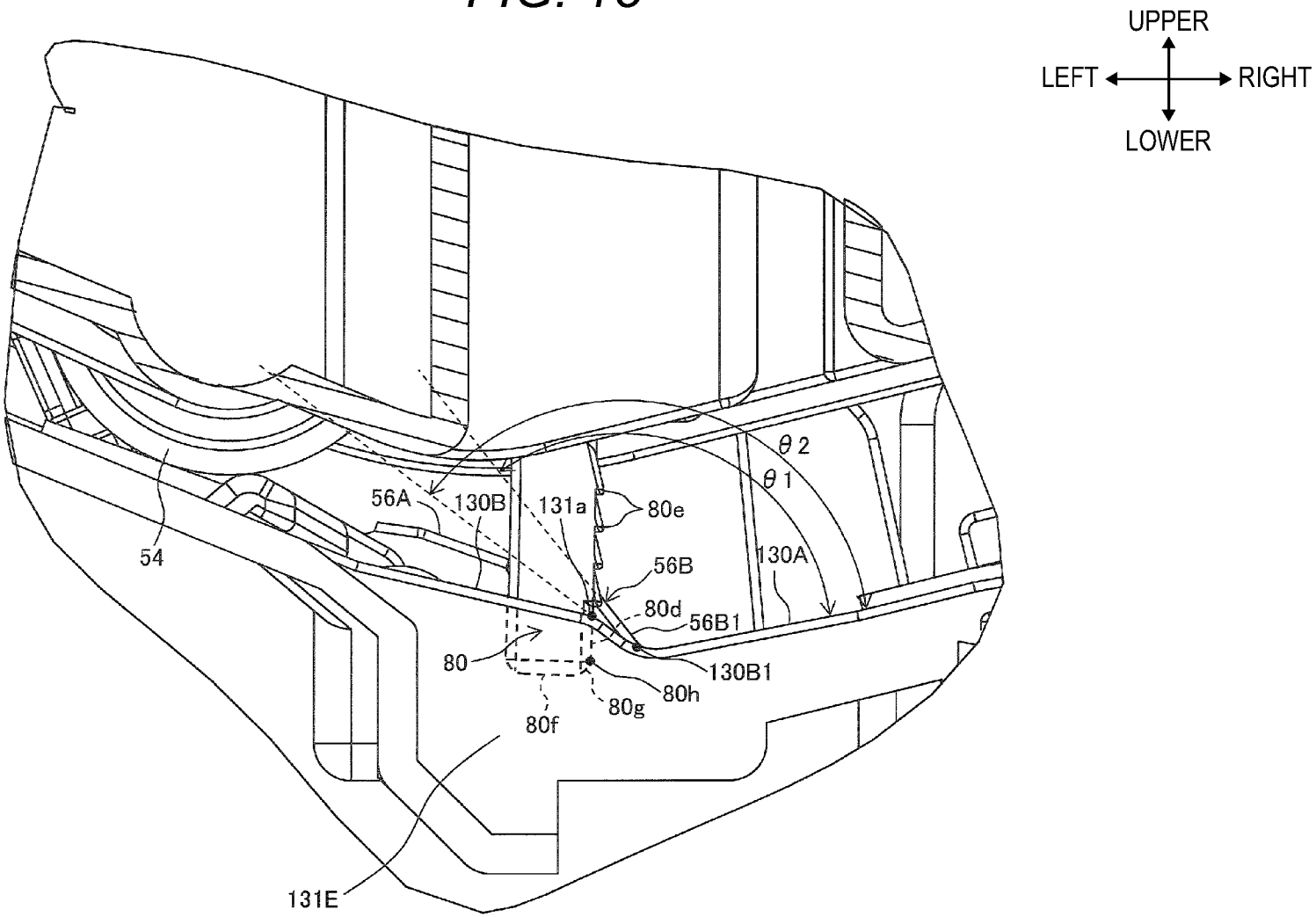
FIG. 15 is a partially enlarged side view showing the appearance configuration of the regulating member and the rib.

FIG. 13 shows an appearance configuration of the ADF with components other than a peripheral structure of the regulating member 80 in the conveyance unit 6 omitted. Further, FIGS. 14 and 15 show the structure of the regulating member 80 in an enlarged manner. Since the regulating members 80F and 80R have the same structure, the regulating members 80F and 80R are simply illustrated as "regulating member 80" in FIGS. 14 and 15 without being distinguished from each other.

As shown in FIG. 13, the ADF 9 includes a pair of front and rear regulating members 80F and 80R that abut against the distal end of the sheet SH in the conveying direction to regulate movement of the sheet SH. As shown in FIGS. 14 and 15, the regulating member 80 has, on a right side that is the upstream side in the conveying direction, a wall surface 80*d* that abuts against the distal end of the sheet SH, and includes a plurality of protrusions 80*e* on the wall surface 80*d*. The plurality of protrusions 80*e* are provided so as to be arranged in a height direction when the regulating member 80 is at a position that regulates passage of the sheet SH shown in FIGS. 14 and 15. The position where the regulating member 80 regulates the passage of the sheet SH is an example of a first position. Each protrusion 80*e* is provided so as to protrude to a right side such that a lower surface thereof directs in a substantially horizontal direction, and is formed such that a shape seen from a front-rear direction is a substantially right-angled triangle. The number of the protrusions 80*e* is not limited to a plurality, and may be, for example, one.

As shown in FIG. 15, the regulating member 80 has a bottom surface 80*f* positioned at a bottom portion, the wall surface 80*d* that abuts against the distal end of the sheet SH, and a curved surface 80*g* that connects the bottom surface 80*f* and the wall surface 80*d*. The curved surface 80*g* is, for example, a surface formed in an R shape by chamfering. The wall surface 80*d* is an example of the abutment surface of the regulating member.

As described above, the upper surface of the upper chute member 130 includes the first upper conveying surface 130A and the second upper conveying surface 130B. The second upper conveying surface 130B is an example of a first inclined surface, and is a support surface inclined upward toward a downstream side in the conveying direction. The first upper conveying surface 130A is an example of a second inclined surface, and is a support surface positioned upstream of the second upper conveying surface 130B in the conveying direction and inclined downward toward the downstream side in the conveying direction.

As shown in FIGS. 13, 14, and 15, the first upper conveying surface 130A and the second upper conveying surface 130B are surfaces including upper surfaces of a plurality of ribs 131A to 131F provided to protrude upward relative to other portions. The ribs 131A to 131F are examples of a first rib. As shown in FIG. 15, on an upper surface of the rib 131E, a predetermined portion 131*a* of the second upper conveying surface 130B in the conveying direction is higher than a highest portion 80*h* of the curved surface 80*g* of the regulating member 80. The predetermined portion 131*a* is positioned at a position in the conveying direction where the wall surface 80*d* is positioned. That is, the rib 131E has a shape in which a vicinity of the predetermined portion 131*a* is curved and raised in an upward direction. Other ribs 131A to 131D and 131F have the same configuration.

As described above, the separation bank 56B is provided between the sheet feeding roller 92 and the separation roller 54. As shown in FIG. 15, the separation bank 56B has the abutment surface 56B1. An angle θ1 formed by the first upper conveying surface 130A and the abutment surface 56B1 of the separation bank 56B is smaller than an angle θ2 formed by the first upper conveying surface 130A and the second upper conveying surface 130B. For example, the angle θ1 is about 135° and the angle θ2 is about 160°. Further, a position of an upstream end portion 130B1 of the second upper conveying surface 130B in the conveying direction is positioned downstream of a position of the abutment surface 56B1 of the separation bank 56B in the conveying direction.

As shown in FIGS. 13 and 14, ribs 133R and 133F are provided between the ribs 131A and 131B and between the ribs 131D and 131E upstream of the regulating members 80R and 80F, respectively, and are opposite to the regulating members 80R and 80F in the conveying direction, respectively. The ribs 133R and 133F are examples of a second rib. As shown in FIG. 14, a height direction position of an upper surface of the rib 133F is lower than a height direction position of an upper surface of the first upper conveying surface 130A. That is, the height direction position of the upper surface of the rib 133F is lower than height direction positions of portions of the ribs 131D and 131E that constitute the first upper conveying surface 130A. Although not shown, the same applies to the rib 133R, a height direction position of an upper surface of the rib 133R is lower than a height direction position of the upper surface of the first upper conveying surface 130A. That is, the height direction position of the upper surface of the rib 133R is lower than height direction positions of portions of the ribs 131A and 131B that constitute the first upper conveying surface 130A.

As shown in FIG. 13, the gear mechanism 15 is provided on a rear side of the separation bank 56B in a width direction of the sheet SH orthogonal to the conveying direction. The regulating member 80 includes the regulating member 80R positioned on the rear side of the separation bank 56B in the width direction and the regulating member 80F positioned on a front side of the separation bank 56B in the width direction. The regulating member 80R is an example of a first-side regulating member, and the regulating member 80F is an example of a second-side regulating member. The ribs 131A to 131F include the three ribs 131A, 131B, and 131C positioned on the rear side of the separation bank 56B in the width direction, the two ribs 131D and 131E positioned on the front side of the separation bank 56B in the width direction, and the rib 131F positioned on the front side of the separation bank 56B in the width direction, provided at a portion where a distance d from a center line CL of the separation bank 56B in the width direction is substantially the same as that of the rib 131A and where the ribs 131D and 131E are not provided. The ribs 131A, 131B, and 131C are examples of a first-side rib, the ribs 131D and 131E are examples of second-side rib, and the rib 131F is an example of a third rib. The center line CL substantially corresponds to a center position of the sheet SH in a width direction. A shape and a height direction position of the upper surface of the rib 131F are substantially the same as shapes and height direction positions of upper surfaces of other ribs 131A to 131E.

Figure 16A:
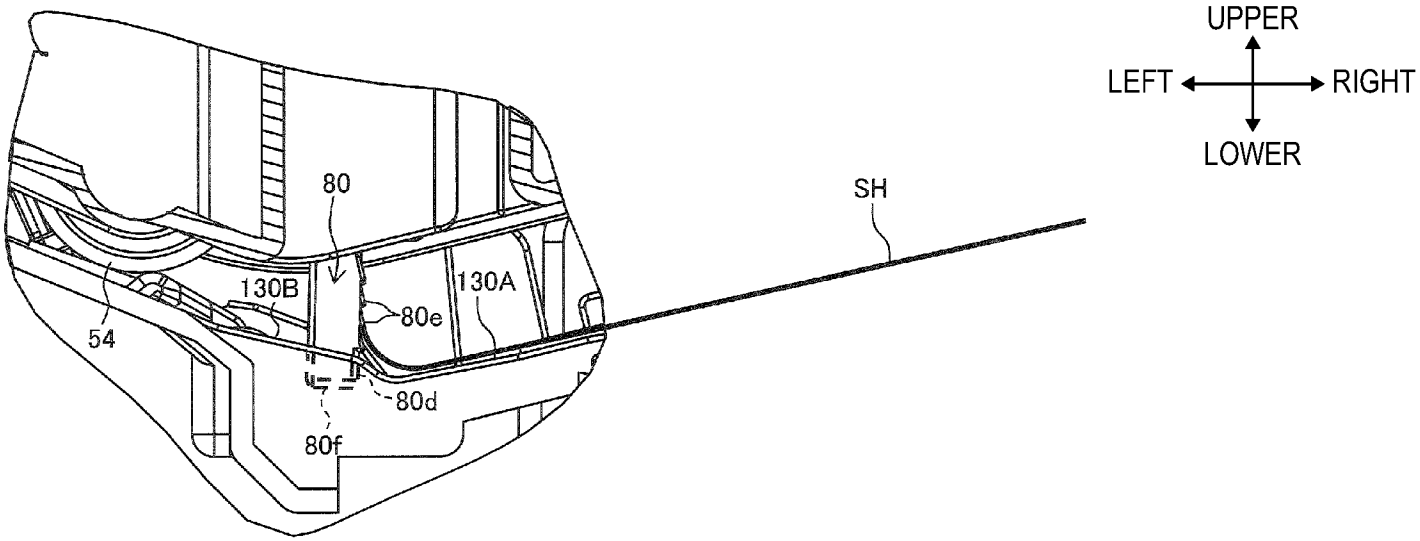
FIGS. 16A and 16B are illustrative diagrams for illustrating an effect of preventing upward and downward curve of a sheet by the regulating member and the rib.
Figure 16B:
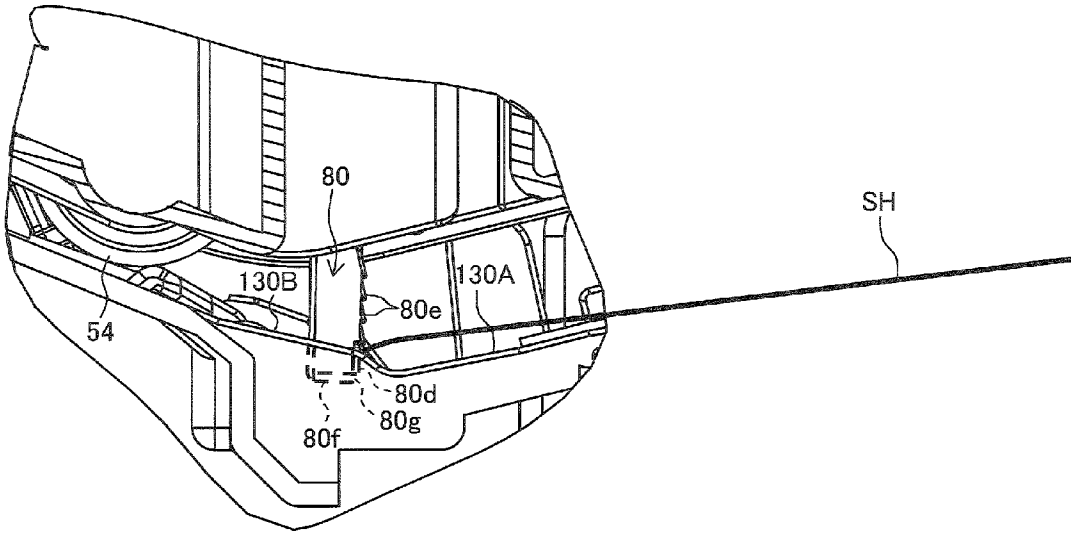

With the above-described configuration of the regulating member 80, as shown in FIG. 16A, even when the distal end of the sheet SH fed by the user slides on a surface of the wall surface 80*d* and is curved upward when the distal end of the sheet SH abuts against the regulating member 80, the distal end of the sheet SH hits and is caught by the protrusions 80*e* of the wall surface 80*d*. Therefore, the upward curve is reduced without becoming large. Further, as shown in FIG. 16B, even when the distal end of the sheet SH fed by the user is curved downward, the distal end of the sheet SH is lifted by a shape of the predetermined portion 131*a* of the second upper conveying surface 130B before reaching the regulating member 80, and is higher than a position of the bottom surface 80*f* when reaching the curved surface 80*g* of the regulating member 80. As a result, the distal end of the sheet SH is prevented from slipping below the bottom surface 80*f* of the regulating member 80.

In this way, the structures of the regulating member 80 and the ribs 131A to 131F, 133R, and 133F reduce upward and downward curve of the sheet SH, so that the fed sheet SH is stably positioned by the regulating member 80. Therefore, in the present embodiment, the sheet placement sensor 112 is disposed such that the sheets SH having a size in which a difference in positions of rear ends of the sheets is not so large can be distinguished from each other and detected by using the stable positioning of the sheets SH.

Figure 17:
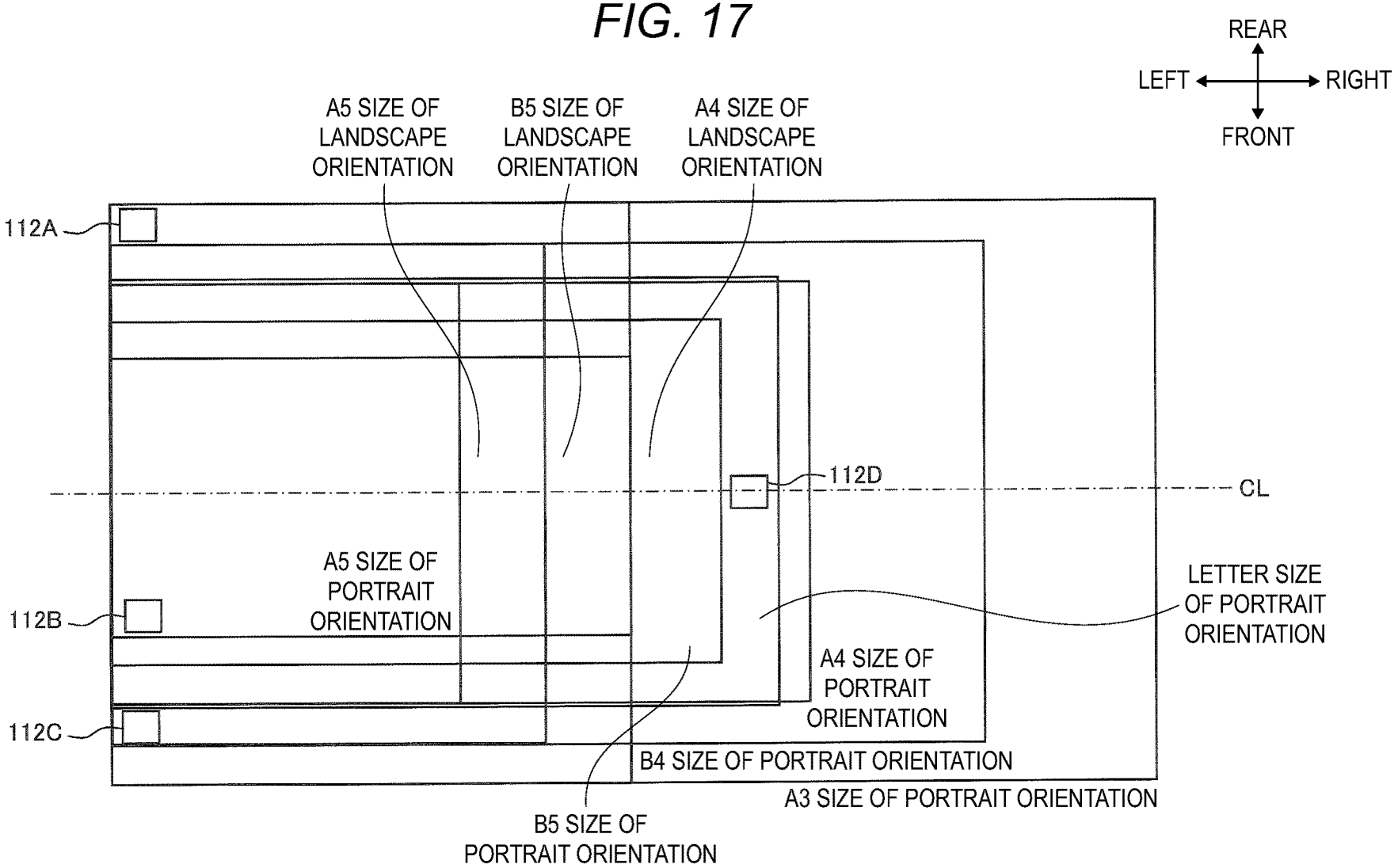
FIG. 17 is a conceptual diagram showing an arrangement of a sheet placement sensor on a loading surface.

FIG. 17 conceptually shows an arrangement of the sheet placement sensor 112 on the loading surface 150A. As shown in FIG. 17, the sheet placement sensor 112 includes four sheet placement sensors 112A to 112D. The sheet placement sensors 112A to 112D are examples of a sensor. The sheet placement sensors 112A to 112D detect presence or absence of the sheet SH in an abutment state where the sheet SH is disposed on the loading surface 150A such that a longitudinal direction of the sheet SH corresponds to the conveying direction and where the distal end of the sheet SH abuts against the regulating member 80. As shown in FIG. 17, among the sheet placement sensors 112A to 112D, the sheet placement sensor 112D is provided at a position between a rear end of the sheet SH of a B5 size of portrait orientation in a state where a distal end of the sheet SH abuts against the regulating member 80 and a rear end of the sheet SH of a LETTER size of portrait orientation in a state where a distal end of the sheet SH abuts against the regulating member 80 in a direction orthogonal to the loading surface 150A, that is, in a plan view from an upper-lower direction. Accordingly, the sheet of the B5 size and the sheet of the LETTER size in which a difference in positions of rear ends of the sheets is not so large can be distinguished from each other and detected.

Effects of Embodiment

As described above, in the multifunction device 1 according to the present embodiment, the regulating member 80 that regulates passage of the sheet SH supported by the first upper conveying surface 130A and the second upper conveying surface 130B in the conveying direction is provided to be displaceable at the first position or the second position. At the first position, the regulating member 80 abuts against the distal end of the sheet SH supported by the first upper conveying surface 130A and regulates the passage of the sheet SH in the conveying direction. At the second position farther from the conveyance path than the first position, the regulating member 80 allows passage of the sheet SH in the conveying direction. When abutting against the distal end of the sheet SH at the first position, the regulating member 80 includes at least one protrusion 80*e* on the wall surface 80*d* that abuts against the distal end of the sheet. Accordingly, when the distal end of the sheet SH fed by the user abuts against the regulating member 80, the distal end of the sheet SH hits and is caught by the protrusions 80*e* of the wall surface 80*d*. Therefore, it is possible to reduce sliding of the distal end of the sheet on the surface of the wall surface 80*d* and curving upward or downward of the distal end of the sheet. Accordingly, usability for the user can be improved.

Particularly, in the present embodiment, when the regulating member 80 is at the first position, the plurality of protrusions 80*e* are arranged in a height direction on the wall surface 80*d*. Accordingly, even when the number of sheets SH to be fed at one time varies between, for example, one to several tens of sheets SH, the sheets SH hit and are caught by any one of the plurality of protrusions 80*e* depending on a thickness of a bundle of the sheets SH, so that the curve can be reduced.

Particularly, in the present embodiment, the sheet placement sensor 112D that detects presence or absence of the sheet SH is provided at the position between the rear end of the sheet SH of the B5 size and the rear end of the sheet SH of the LETTER size in a plan view. Further, in the present embodiment, the curve is reduced as described above, so that the fed sheet SH is stably positioned by the regulating member 80. Accordingly, when the sheet SH of the B5 size is fed, a detection result of the sheet placement sensor 112D becomes "absence of sheet" with high accuracy, and when the sheet of the LETTER size is fed, a detection result of the sheet placement sensor 112D becomes "presence of sheet" with high accuracy. As a result, the sheet of the B5 size and the sheet of the LETTER size, in which the difference in the positions of the rear ends of the sheets is not so large when the sheets are fed with a sheet longitudinal direction corresponding to the conveying direction, can be distinguished from each other and detected.

Particularly, in the present embodiment, the regulating member 80 has the curved surface 80*g* that is positioned at a lower side in the first position and connects the bottom surface 80*f* and the wall surface 80*d*. When the regulating member 80 abuts against the distal end of the sheet SH at the first position, the predetermined portion 131*a* of the second upper conveying surface 130B whose position in the conveying direction is the same as that of the wall surface 80*d* is higher than the highest portion of the curved surface 80*g*. Accordingly, when the sheet SH is fed, the distal end thereof is lifted by the predetermined portion 131*a* of the second upper conveying surface 130B before reaching the regulating member 80, and becomes higher than the position of the bottom surface 80*f* when a position in the conveying direction reaches the same position as that of the wall surface 80*d*. As a result, it is possible to reduce curving downward of the distal end of the sheet SH so as to slip under the bottom surface 80*f* of the regulating member 80. As a result, usability for the user can be improved.

Particularly, in the present embodiment, the angle θ1 formed by the first upper conveying surface 130A and the abutment surface 56B1 of the separation bank 56B is smaller than the angle θ2 formed by the first upper conveying surface 130A and the second upper conveying surface 130B. In other words, the second upper conveying surface 130B is in a state of being more horizontal and sideways than the abutment surface 56B1 of the separation bank 56B. Accordingly, when the sheet SH is fed, it is possible to reduce a possibility that the distal end of the sheet abuts against the second upper conveying surface 130B before the abutment surface 56B1 of the separation bank 56B and friction with the second upper conveying surface 130B induces a conveyance abnormality.

Particularly, in the present embodiment, the position of the upstream end portion 130B1 of the second upper conveying surface 130B is positioned downstream of the abutment surface 56B1 of the separation bank 56B in the conveying direction. Accordingly, when the sheet SH is fed, it is possible to reduce the possibility that the distal end of the sheet abuts against the second upper conveying surface 130B before the abutment surface 56B1 of the separation bank 56B and the friction with the second upper conveying surface 130B induces the conveyance abnormality.

Particularly, in the present embodiment, at least a part of the second upper conveying surface 130B includes the upper surfaces of the ribs 131A to 131F that protrude upward relative to other portions. Accordingly, the second upper conveying surface 130B can lift the distal end of the sheet SH while reducing friction by reducing a contact area with the sheet SH as much as possible.

Particularly, in the present embodiment, the ribs 133R and 133F different from the ribs 131A to 131F are provided and positioned opposite to the regulating member 80 in the conveying direction on the upstream side of the regulating member 80. Accordingly, the distal end of the fed sheet SH can be smoothly guided to the regulating member 80, and downward curve prevention function of the ribs 131A to 131F can be assisted. Further, at this time, since the height direction positions of the upper surfaces of the ribs 133R and 133F are lower than the upper surface of the first upper conveying surface 130A, it is possible to reduce a possibility that when the sheet SH is fed, the sheet SH abuts against the ribs 133R and 133F before the first upper conveying surface 130A and friction with the ribs 133R and 133F induces a conveyance abnormality.

Particularly, in the present embodiment, the regulating member 80 is switched to the first position or the second position by the switching mechanism based on the driving force input from the motor 70 to the rotation shaft 54S of the separation roller 54. Further, the gear mechanism 15 that transmits the driving force input from the motor 70 to the rotation shaft 54S of the separation roller 54 to the rotation shaft 92S of the sheet feeding roller 92 is provided, and the gear mechanism 15 is provided on the rear side in the sheet width direction with respect to the separation bank 56B.

In this way, as a result of the configuration in which the motor driving force serving as the driving source of the regulating member 80 is also transmitted to the sheet feeding roller side by the gear mechanism 15, the center line in the width direction between the two regulating members 80R and 80F arranged on one side and the other side of the separation bank 56B in the sheet width direction may be eccentric with respect to the center line CL of the separation bank 56B in the width direction. In this case, a center line in the width direction between the ribs 131A and 131B and the ribs 131D and 131E provided at the corresponding positions in the width direction in order to reduce curving at the regulating members 80R and 80F is also eccentric with respect to the center line CL of the separation bank 56B in the width direction. That is, distances to the ribs 131A and 131B and distances to the ribs 131D and 131E are different when viewed from the center line CL of the separation bank 56B in the width direction substantially equal to a center position of the conveyed sheet SH in the width direction. As a result, when the fed sheet SH is conveyed as it is, a frictional force that acts on an area on the one side of the sheet SH and a frictional force that acts on an area on the other side of the sheet SH when viewed from the center position of the sheet SH in the width direction may become unbalanced, which may cause skew movement.

Therefore, in the present embodiment, the rib 131F for applying a frictional force is provided at a portion where the distance d from the center line CL of the separation bank 56B in the width direction is substantially the same as that of the rib 131A and where the ribs 131D and 131E are not provided. Then, the shape and the height direction position of the upper surface of the rib 131F are substantially the same as those of the upper surfaces of other ribs 131A to 131E. Accordingly, when the sheet SH is conveyed, since it is possible to balance the acting frictional forces by making the number, shapes, and the like of the ribs substantially uniform in the area on one side and the area on the other side of the sheet SH when viewed from the center position of the sheet SH in the width direction, occurrence of skew movement can be reduced.

The present disclosure is not limited to the above-described embodiment and various modifications can be made within the scope not deviating from the gist and technical idea thereof. These modifications are also included in the technical scope.

That is, in the above description, the regulating member 80 is configured to move in and out of the conveyance path P1 of the sheet SH by rotating, but the present disclosure is not limited thereto. That is, for example, a solenoid, an electromagnetic clutch, or the like may be used to move the regulating member up and down to move in and out of the conveyance path P1. In this case, there is provided the switching mechanism that implements the regulated state by moving the regulating member upward or downward to the first position positioned on a conveyance path P1 side, and implements the regulation release state by moving the regulating member downward or upward to the second position farther from the conveyance path P1 than the first position.

Further, in the above description, a case where the rotatable lock lever 100 is provided has been described as an example, but the configuration of the lock lever is not limited thereto, and any configuration may be used as long as the regulating member 80 can be switched to the regulated state or the open state in conjunction with the rotation of the holder 51. That is, for example, a member such as a bar or a plate that does not rotate and linearly moves to abut against or engage with the regulating member 80, such as a lever, may also be used as the lock lever.

In the above description, the swing of the holder 51 is also implemented using the driving force from the motor 70, but the present disclosure is not limited thereto. That is, the holder 51 may be swung using a driving force from a driving source different from the motor 70.

In the above description, a case where the present disclosure is applied to the document sheet feeding mechanism in the ADF 9 when the document is inserted into the ADF 9 by the user has been described as an example, but the present disclosure is not limited thereto. That is, the present disclosure may be applied to a manual sheet feeding mechanism when the user inserts a recording sheet from a manual sheet feeding port separately provided in the main body unit 2. Also in this case, the same effects as described above are obtained.

Further, the above description has been made by taking the multifunction device 1 as an example of the image processing apparatus, but the present disclosure is not limited thereto. That is, as another example of the image processing apparatus, the present disclosure may be applied to a reading apparatus including only a portion corresponding to the reader 3 without including a portion corresponding to the image forming unit 4. Also in this case, the same effects as described above are obtained.

In addition to those described above, the methods according to the above-described embodiment and the modifications may be used in combination as appropriate.

Though not specifically exemplified, the present disclosure should be put into practice with various changes made in a range not departing from its spirit.

What is claimed is:

1. An image processing apparatus comprising:

a support surface configured to support a sheet;

a sheet feeding roller configured to feed the sheet supported by the support surface in a conveying direction;

a separation member for separating the sheet supported by the support surface one by one, the separation member being positioned downstream of the sheet feeding roller in the conveying direction; and a regulating member displaceable between a first position and a second position, the first position being a position where the regulating member abuts against a distal end of the sheet supported by the support surface to regulate passage of the sheet in the conveying direction between the sheet feeding roller and the separation member, the second position being a position that is farther from a conveyance path than the first position and that allows passage of the sheet in the conveying direction, the regulating member having a wall surface that abuts against the distal end of the sheet and including at least one protrusion on the wall surface, wherein the support surface intersects the regulating member at an inclined surface of a predetermined portion of the support surface when viewed from a direction orthogonal to the conveying direction, the predetermined portion being inclined upward to a downstream side in the conveying direction and being positioned at a position in the conveying direction where the abutment surface is positioned when the regulating member is at the first position.

2. The image processing apparatus according to claim 1, wherein the at least one protrusion comprises a plurality of protrusions, and wherein the regulating member includes the plurality of protrusions on the wall surface, the plurality of protrusions being arranged in a height direction at the first position.

3. The image processing apparatus according to claim 1, further comprising:

a sensor configured to detect presence or absence of the sheet in an abutment state where the sheet is disposed on the support surface such that a longitudinal direction of the sheet corresponds to the conveying direction and where a distal end of the sheet abuts against the regulating member at the first position, wherein, in a plan view from a direction orthogonal to the support surface, the sensor is provided at a position between a rear end of the sheet of a B5 size in the abutment state and a rear end of the sheet of a LETTER size in the abutment state.

4. The image processing apparatus according to claim 1, wherein the separation member is a separation roller.

5. The image processing apparatus according to claim 1, wherein the protrusion is formed such that a shape seen from a direction orthogonal to the conveying direction is a triangle.

6. The image processing apparatus according to claim 1, wherein the protrusion is formed such that the shape seen from a direction orthogonal to the conveying direction is a substantially right-angled triangle.

7. The image processing apparatus according to claim 6, wherein the protrusion is provided so as to protrude in an upstream side in the conveying direction such that a lower surface of the protrusion directs in a substantially horizontal direction.

8. An image processing apparatus comprising:

a support surface configured to support a sheet;

a sheet feeding roller configured to feed the sheet supported by the support surface in a conveying direction;

a separation member for separating the sheet supported by the support surface one by one, the separation member being positioned downstream of the sheet feeding roller in the conveying direction; and a regulating member displaceable between the first position and a second position, the first position being a position where the regulating member abuts against a distal end of the sheet supported by the support surface to regulate passage of the sheet in the conveying direction between the sheet feeding roller and the separation member, the second position being a position that is farther from a conveyance path than the first position and that allows passage of the sheet in the conveying direction, the regulating member having:

a bottom surface positioned at a bottom portion when the regulating member is at the first position, an abutment surface that abuts against the distal end of the sheet when the regulating member is at the first position, and a curved surface that connects the bottom surface and the abutment surface, wherein a predetermined portion of the support surface in the conveying direction is higher than a highest portion of the curved surface, the predetermined portion being positioned at a position in the conveying direction where the abutment surface is positioned, wherein the separation member includes a separation bank having an abutment surface for separating an uppermost sheet among a plurality of sheets when the plurality of sheets are fed by the sheet feeding roller, wherein the support surface includes:

a first inclined surface including the predetermined portion and inclined upward toward a downstream side in the conveying direction, and a second inclined surface positioned upstream of the first inclined surface in the conveying direction and inclined downward toward the downstream side in the conveying direction, and wherein an angle formed by the second inclined surface and the abutment surface of the separation bank is smaller than an angle formed by the second inclined surface and the first inclined surface.

9. The image processing apparatus according to claim 8, wherein a position of an upstream end portion of the first inclined surface in the conveying direction is downstream of a position of the abutment surface of the separation bank in the conveying direction.

10. The image processing apparatus according to claim 8, further comprising:

a first rib protruding upward from the support surface, wherein the first inclined surface includes an upper surface of the first rib.

11. The image processing apparatus according to claim 10, further comprising:

a second rib provided upstream of the regulating member and opposite to the regulating member in the conveying direction, wherein a height direction position of an upper surface of the second rib is lower than a height direction position of an upper surface of the second inclined surface.

12. The image processing apparatus according to claim 10, wherein the separation member includes a separation roller, wherein the image processing apparatus further comprises:

a motor;

a switching mechanism configured to switch the regulating member to the first position or the second position in response to an input of a driving force of the motor to a driving shaft of the separation roller; and a gear mechanism interposed between the driving shaft of the separation roller and a driving shaft of the sheet feeding roller and configured to transmit the driving force input from the motor to the driving shaft of the separation roller to the driving shaft of the sheet feeding roller, the gear mechanism being provided on a first side of the separation bank in a width direction of the sheet orthogonal to the conveying direction, wherein the regulating member includes:

a first-side regulating member positioned on the first side of the separation bank in the width direction, and a second-side regulating member positioned on a second side of the separation bank in the width direction opposite to the first side, wherein the first rib includes:

a first-side rib positioned on the first side of the separation bank in the width direction, a second-side rib positioned on the second side of the separation bank in the width direction, and a third rib positioned on the second side of the separation bank in the width direction, the third rib being positioned at a portion where a distance from a center line of the separation bank in the width direction is substantially the same as that of the first-side rib and where the second-side rib is not provided, and wherein a shape and a height direction position of an upper surface of the third rib are substantially the same as a shape and a height direction position of an upper surface of the first-side rib.

* * * * *